US011458744B2

(12) United States Patent
Takimoto

(10) Patent No.: US 11,458,744 B2
(45) Date of Patent: Oct. 4, 2022

(54) IMAGE FORMING APPARATUS

(71) Applicant: BROTHER KOGYO KABUSHIKI KAISHA, Nagoya (JP)

(72) Inventor: Yuji Takimoto, Handa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 244 days.

(21) Appl. No.: 16/653,557

(22) Filed: Oct. 15, 2019

(65) Prior Publication Data

US 2021/0107301 A1 Apr. 15, 2021
US 2022/0001679 A9 Jan. 6, 2022

(30) Foreign Application Priority Data

Oct. 18, 2018 (JP) ..... JP2018-196950

(51) Int. Cl.
*B41J 2/01* (2006.01)
*B41J 11/00* (2006.01)

(52) U.S. Cl.
CPC ..... *B41J 11/0045* (2013.01)

(58) Field of Classification Search
None
See application file for complete search history.

(56) References Cited

U.S. PATENT DOCUMENTS 9,975,714 B2 * 5/2018 Hirata ..... B65H 31/24
2005/0231743 A1 * 10/2005 Noh ..... G03G 15/6573 358/1.12
2012/0061902 A1 3/2012 Ino
2013/0250328 A1 * 9/2013 Ohtsuka ..... B65H 83/025 358/1.13
2016/0154358 A1 6/2016 Hashimoto

FOREIGN PATENT DOCUMENTS

| | | | |
|---|---|---|---|
| JP | S64-021166 U | | 2/1989 |
| JP | H0597320 A | * | 4/1999 |
| JP | 2005-075609 A | | 3/2005 |
| JP | 2012-062133 A | | 3/2012 |
| JP | 2016-101992 A | | 6/2016 |
| JP | 2017-178577 A | | 10/2017 |
| JP | 2018-165203 A | | 10/2018 |

OTHER PUBLICATIONS

Kakigi, Motofumi, Paper Discharge Tray, Apr. 20, 1993, Japan (Year: 1993).*

* cited by examiner

*Primary Examiner* — Erica S Lin
*Assistant Examiner* — Tracey M McMillion
(74) *Attorney, Agent, or Firm* — Baker Botts L.L.P.

(57) ABSTRACT

An image forming apparatus includes a discharge tray, a sheet contact plate, an arm, a slider, and a spring. The sheet contact plate includes a first end portion and a second end portion located downstream in a sheet discharge direction and is pivotable about a first axis located at the first end portion between a retracted position and a protruding position. The arm includes a third end portion and a fourth end portion. The third end portion is supported by the second end portion of the sheet contact plate such that the arm is pivotable about a second axis located at the third end portion. The slider supports the fourth end portion of the arm such that the arm is pivotable about a third axis located at the fourth end portion. The spring urges the slider away from the first axis along the sheet discharge direction.

20 Claims, 14 Drawing Sheets

IMAGE FORMING APPARATUS

CROSS-REFERENCE TO RELATED APPLICATION

This application claims priority from Japanese Patent Application No. 2018-196950 filed on Oct. 18, 2018, the content of which is incorporated herein by reference in its entirety.

TECHNICAL FIELD

Aspects of the disclosure relate to an image forming apparatus including a sheet contact plate contactable with a discharged sheet on a discharge tray.

BACKGROUND

Some known image forming apparatus includes a sheet contact plate. The sheet contact plate is contactable with one or more sheets on a discharge tray and regulates movement of the one or more sheets contacting the sheet contact plate.

The sheet contact plate is supported by the discharge tray so as to be pivotable about an axis between a retracted position and a protruding position. At the retracted position, the sheet contact plate is accommodated in the discharge tray. At the protruding position, the sheet contact plate protrudes relative to the discharge tray.

The sheet contact plate is urged toward the protruding position by springs in a direction in which the sheet contact plate pivots. The sheet contact plate is configured such that, in response to application of a load to the sheet contact plate located at the protruding position, the sheet contact plate pivots toward the retracted position against urging force of the springs to reduce risk of damage to the sheet contact plate.

The known sheet contact plate includes a pivot shaft having the pivot axis of the sheet contact plate. The springs such as coil springs are attached to the respective end portions of the pivot shaft. The coil springs urge the sheet contact plate toward the protruding position.

SUMMARY

Such springs disposed at the pivot shaft may need to have a relatively large urging force for holding the sheet contact plate at the protruding position. Nevertheless, if the springs have a relatively large urging force, an excessive force may be exerted on portions of the sheet contact plate that may contact the springs, which may result in deformation of the sheet contact plate.

Accordingly, aspects of the disclosure provide an image forming apparatus including a sheet contact plate having a relatively low risk of deformation.

In one aspect of the disclosure, an image forming apparatus includes a discharge tray, a sheet contact plate, an arm, a slider, and a spring. The discharge tray is configured to receive and hold a discharged sheet having an image formed thereon. The sheet contact plate is supported by the discharge tray. The sheet contact plate includes a first end portion and a second end portion that is located downstream from the first end portion in a sheet discharge direction. The sheet contact plate is pivotable on a first axis located at the first end portion between a retracted position and a protruding position. The sheet contact plate located at the protruding position is contactable with the discharged sheet. The arm includes a third end portion and a fourth end portion in a direction in which the arm extends. The third end portion is supported by the second end portion of the sheet contact plate such that the arm is pivotable on a second axis located at the third end portion. The slider is disposed at the discharge tray. The slider is slidable along the sheet discharge direction. The slider supports the fourth end portion of the arm such that the arm is pivotable on a third axis located at the fourth end portion. The spring urges the slider away from the first axis along the sheet discharge direction.

In another aspect of the disclosure, an image forming apparatus includes a discharge tray, a sheet contact plate, a slider, an arm, and a spring. The sheet contact plate is supported by the discharge tray. The sheet contact plate includes a first end portion and a second end portion that is located downstream from the first end portion in a sheet discharge direction. The sheet contact plate is pivotable about a first axis located at the first end portion between a retracted position and a protruding position. The slider is slidable along the sheet discharge direction. The arm includes a third end portion and a fourth end portion opposite to the third end portion in a direction in which the arm extends. The third end portion is supported by the second end portion of the sheet contact plate such that the arm is pivotable about a second axis located at the third end portion. The fourth end portion is supported by the slider such that the arm is pivotable about a third axis located at the fourth end portion. The spring urges the slider away from the first axis with respect to the sheet discharge direction.

According to one or more aspects of the disclosure, the second axis may be located at a particular position away from the first axis that is a pivot center of the sheet contact plate. The second axis may be the point to which a force is applied when the arm holds the sheet contact plate at the protruding position. Such a configuration may thus require a relatively small force for holding the sheet contact plate at the protruding position, thereby reducing risk of deformation of the sheet contact plate.

DETAILED DESCRIPTION

Illustrative embodiments will be described with reference to the accompanying drawings.

Overall Configuration of Image Forming Apparatus

Figure 1:
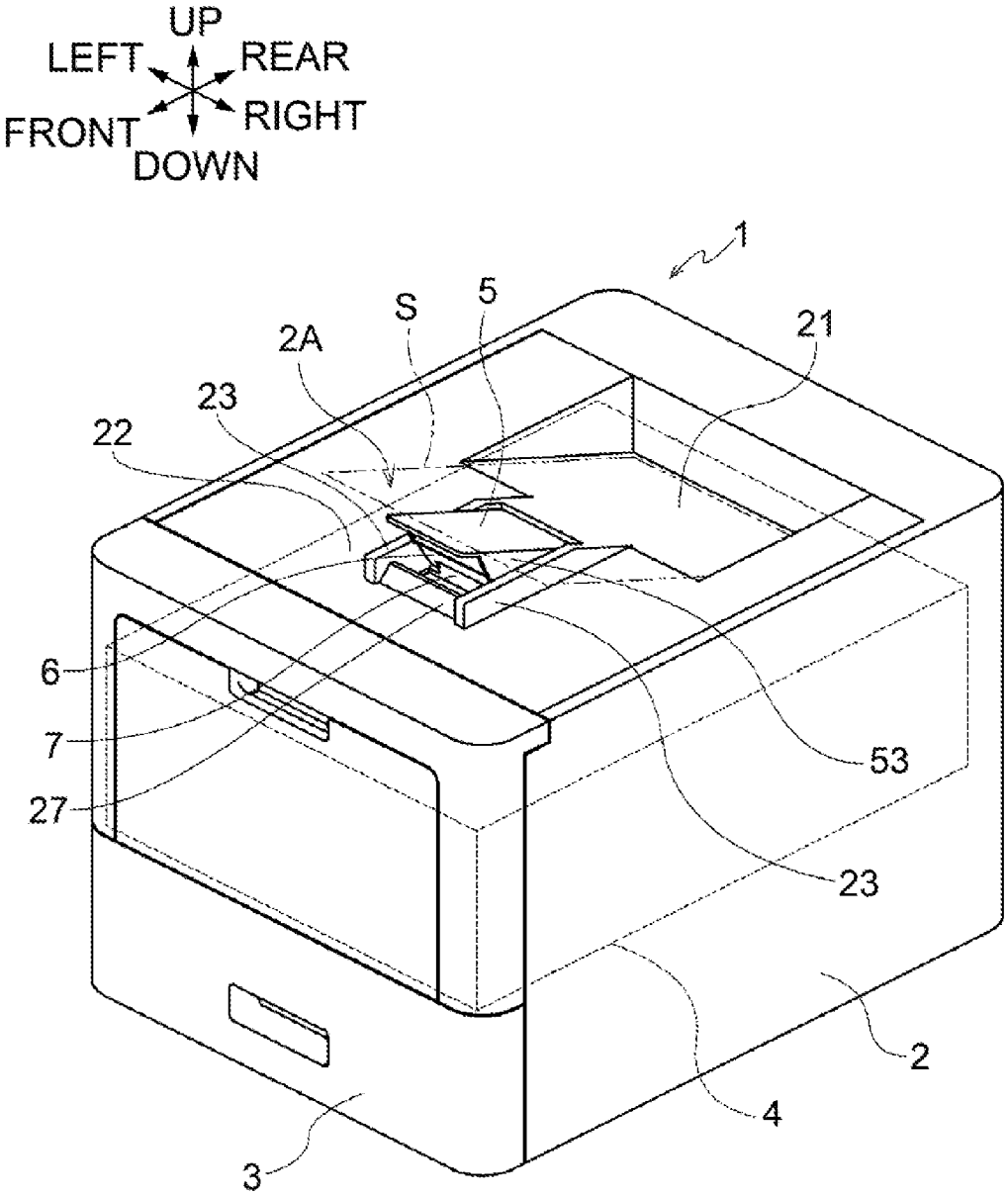
FIG. 1 is a perspective view of an image forming apparatus according to a first illustrative embodiment of the disclosure.

An image forming apparatus 1 illustrated in FIG. 1 is an example of an image forming apparatus.

Hereinafter, directions of up, down, right, left, front, and rear may be defined with reference to an orientation of the image forming apparatus 1 that may be disposed in which it may be intended to be used as illustrated in FIG. 1.

Figure 2:
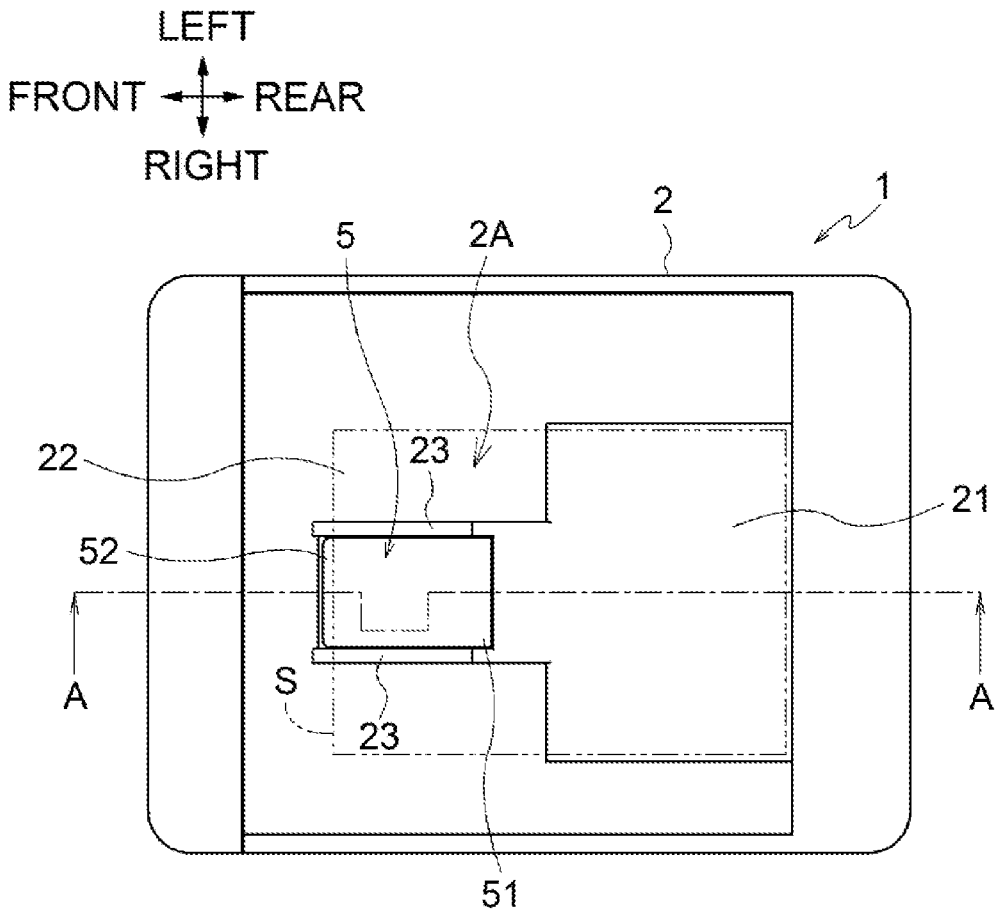
FIG. 2 is a plan view of the image forming apparatus according to the first illustrative embodiment of the disclosure.
Figure 3:
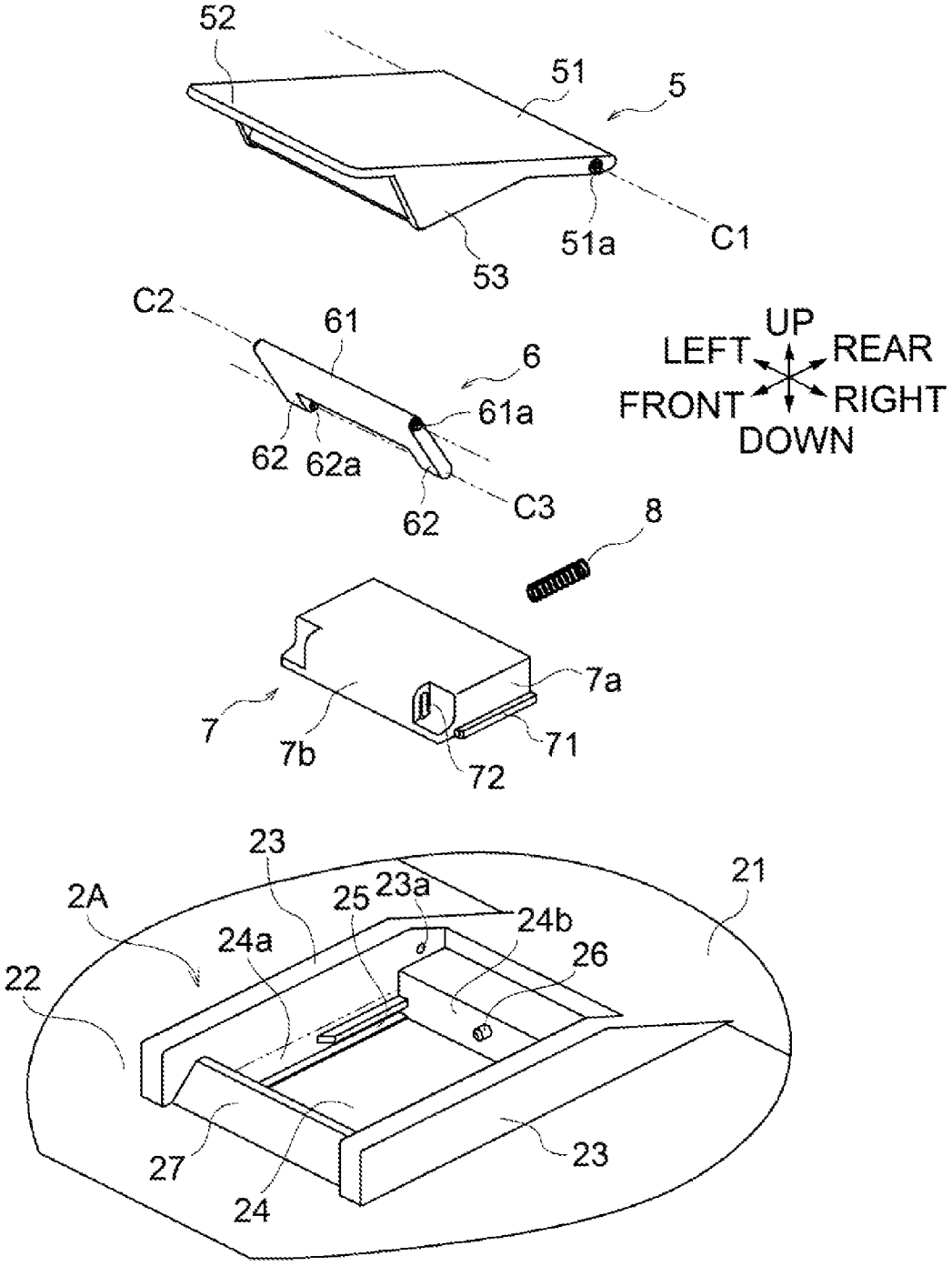
FIG. 3 is a disassembled perspective view illustrating a sheet contact plate and a support structure for the sheet contact plate according to the first illustrative embodiment of the disclosure.
Figure 4:
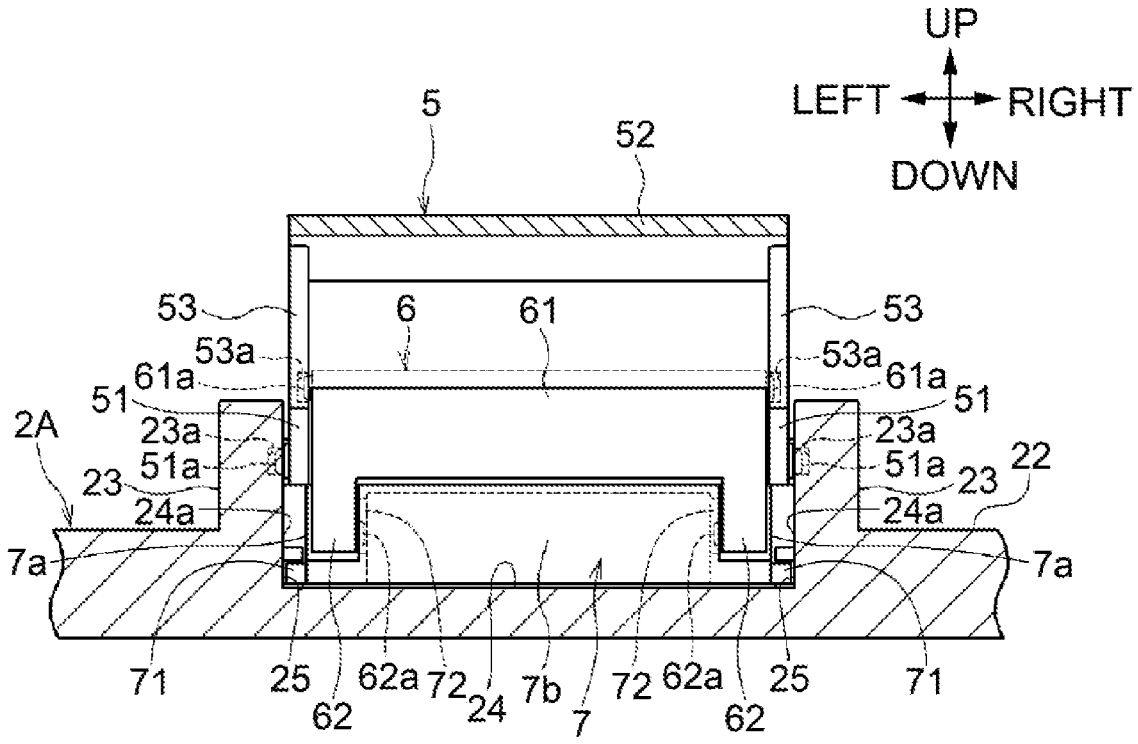
FIG. 4 is a sectional front view of the sheet contact plate and the support structure for the sheet contact plate taken along line B-B of FIG. 5A according to the first illustrative embodiment of the disclosure.

As illustrated in FIGS. 1 and 2, the image forming apparatus 1 includes a housing 2, a sheet cassette 3, and an image forming unit 4. The sheet cassette 3 is configured to accommodate one or more sheets S. The image forming unit 4 is configured to form an image onto a sheet S. The housing 2 has a substantially rectangular parallelepiped shape. The housing 2 houses the sheet cassette 3 and the image forming unit 4.

The housing 2 includes a discharge tray 2A at its top. The discharge tray 2A is configured to receive and hold a discharged sheet S having an image formed by the image forming unit 4. The image forming apparatus 1 further includes a sheet discharge mechanism configured to discharge a sheet S having an image onto the discharge tray 2A from a rear end portion of the housing 2 toward the front. That is, the sheet discharge direction extends along a front-rear direction.

The discharge tray 2A includes an inclined surface portion 21 and a horizontal surface portion 22. The inclined surface portion 21 extends diagonally upward toward the front from a rear end portion of the housing 2. The horizontal surface portion 22 is located in front of the inclined surface portion 21.

The discharge tray 2A further includes a sheet contact plate 5 at the horizontal surface portion 22. The sheet contact plate 5 is contactable with one or more discharged sheets S on the discharge tray 2A.

In sheet discharge onto the discharge tray 2A, a sheet S may first contact the inclined surface portion 21 that may be a rear part of the discharge tray 2A, and then a leading edge portion of the sheet S may reach and contact the sheet contact plate 5 disposed at the horizontal surface portion 22. The sheet contact plate 5 may restrict the movement of sheets S, thereby reducing risk of the sheets S falling from the discharge tray 2A and enabling alignment of the sheets S on the discharge tray 2A.

The sheet cassette 3 is disposed at a lower portion of the housing 2. The sheet cassette 3 is housed in the housing 2 so as to be slidable relative to the housing 2 in the front-rear direction. The image forming unit 4 is disposed above the sheet cassette 3. The image forming unit 4 may adopt any image forming method, for example, a laser printing method or an inkjet printing method.

Sheet Contact Plate and Support Structure for Sheet Contact Plate According to First Illustrative Embodiment A description will be provided on the sheet contact plate 5 and a support structure for the sheet contact plate 5 according to a first illustrative embodiment.

As illustrated in FIGS. 3, 4, 5A, and 5B, the sheet contact plate 5 includes a first end portion 51 and a second end portion 52. The first end portion 51 may be located on the rear side. The second end portion 52 may be located on the front side. The rear side is an example of an upstream side in the sheet discharge direction. The front side is an example of a downstream side in the sheet discharge direction.

The sheet contact plate 5 is supported by the horizontal surface portion 22 of the discharge tray 2A such that the sheet contact plate 5 is pivotable about a first axis C1. The first axis C1 extends along a right-left direction perpendicular to the sheet discharge direction. The first axis C1 is located at the first end portion 51. The sheet contact plate 5 includes pivot shafts 51*a* at the first end portion 51. The pivot shafts 51*a* protrude outward from right and left ends, respectively, of the sheet contact plate 5 and extend in the right-left direction. The pivot shafts 51*a* have a common axis that may be the first axis C1 as their rotation center.

The discharge tray 2A further includes a pair of ribs 23. The ribs 23 extend in the front-rear direction and protrude upward from the horizontal surface portion 22. The ribs 23 are spaced from each other by a predetermined distance in the right-left direction. The ribs 23 have respective inner surfaces facing each other. Each rib 23 has an engagement hole 23*a* in its inner surface. Each engagement hole 23*a* is located at a rear end portion of a corresponding rib 23. Each engagement hole 23*a* is engaged with a corresponding pivot shaft 51*a* of the sheet contact plate 5 and allows the corresponding pivot shaft 51*a* to rotate therein.

The sheet contact plate 5 is supported by the discharge tray 2A through the engagement of the pivot shafts 51*a* and the respective engagement holes 23*a* such that the sheet contact plate 5 is pivotable about the first axis C1.

The sheet contact plate 5 is disposed between the ribs 23 in the right-left direction. That is, the ribs 23 are located on opposite sides (e.g., one side and the other side) of the sheet contact plate 5 in a direction in which the first axis C1 extends (hereinafter, referred to as the first-axis direction), and are elongated in the front-rear direction perpendicular to the first-axis direction.

Figure 5A:
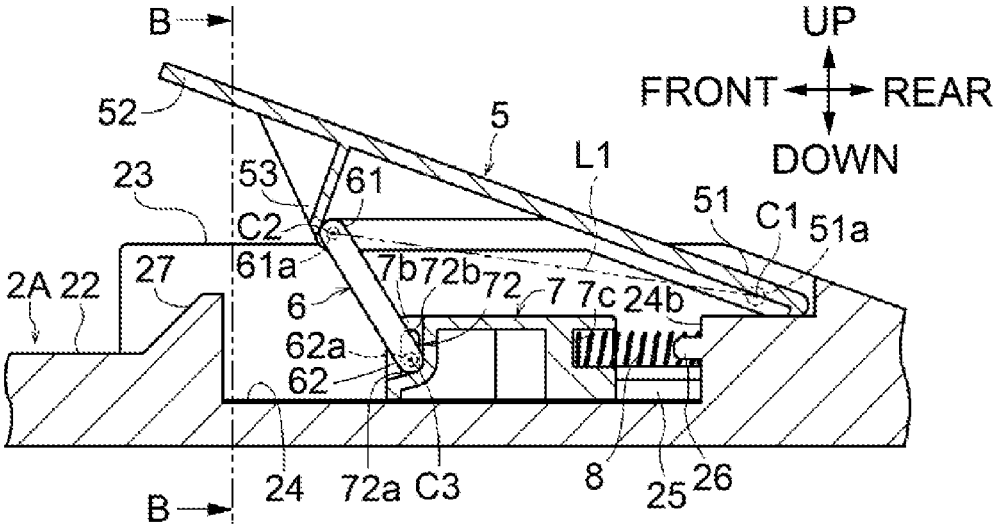
FIG. 5A is a sectional side view of the sheet contact plate and the support structure for the sheet contact plate taken along line A-A of FIG. 2 according to the first illustrative embodiment of the disclosure, wherein the sheet contact plate is located at a protruding position.
Figure 5B:
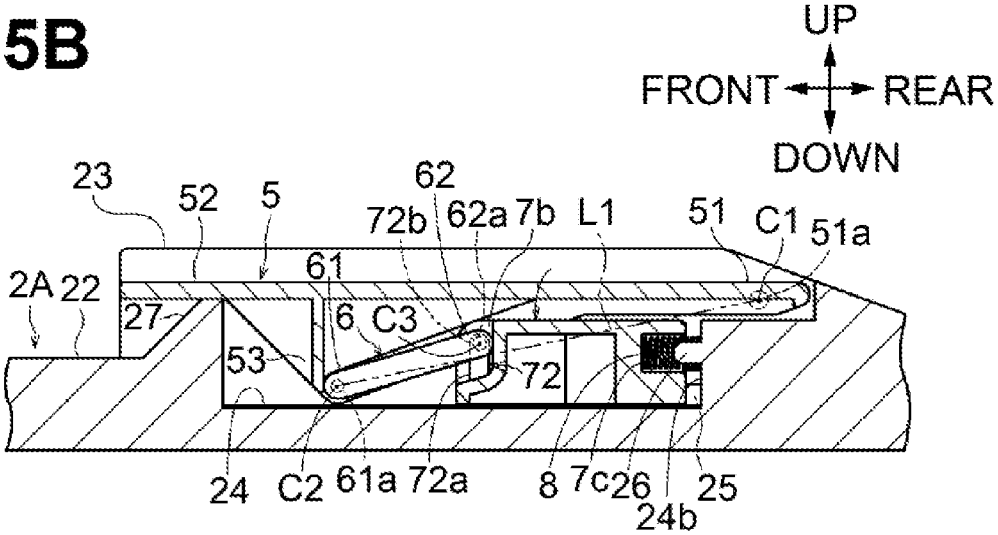
FIG. 5B is a sectional side view of the sheet contact plate and the support structure for the sheet contact plate taken along line A-A of FIG. 2 according to the first illustrative embodiment of the disclosure, wherein the sheet contact plate is located at a retracted position.

The sheet contact plate 5 is pivotable about the first axis C1 between a retracted position and a protruding position. As illustrated in FIG. 5B, when the sheet contact plate 5 is located at the retracted position, the entirety of the sheet contact plate 5 is positioned lower than upper ends of the ribs 23 (only one of the ribs 23 is illustrated in FIG. 5B). As illustrated in FIG. 5A, when the sheet contact plate 5 is located at the protruding position, a portion of the sheet contact plate 5 protrudes upward relative to the upper ends of the ribs 23 (only one of the ribs 23 is illustrated in FIG. 5A). When the sheet contact plate 5 is located at the protruding position, the sheet contact plate 5 may contact a sheet S held by the discharge tray 2A. When the sheet contact plate 5 is located at the retracted position, the sheet contact plate 5 extends parallel to the horizontal surface portion 22.

The sheet contact plate 5 further includes stiffening ribs 53. The stiffening ribs 53 extend from the right and left ends, respectively, of the sheet contact plate 5 toward the discharge tray 2A. The stiffening ribs 53 are shaped like a triangle having a vertex angle at its lower end. The stiffening ribs 53 have respective inner surfaces facing each other. Each stiffening rib 53 has a support hole 53*a* in its inner surface. The support hole 53*a* is located close to the vertex angle of each stiffening rib 53. The support holes 53*a* are located closer to the second end portion 52 than to the first end portion 51 of the sheet contact plate 5 in the front-rear direction.

The discharge tray 2A further includes a recessed portion 24 between the right and left ribs 23. The recessed portion 24 is recessed downward relative to the horizontal surface portion 22. The recessed portion 24 has side walls 24*a* defining its right and left ends and a rear wall 24*b* defining its rear end. The rear wall 24*b* is positioned further to the front than the engagement holes 23*a* of the ribs 23.

Each side wall 24*a* has a guide groove 25 extending along the sheet discharge direction. The rear wall 24*b* includes a protrusion 26 protruding toward the front.

The discharge tray 2A further includes a stopper 27 that defines a front end of the recessed portion 24. The stopper 27 protrudes upward relative to the horizontal surface portion 22. When the sheet contact plate 5 is located at the retracted position and extends parallel to the horizontal surface portion 22, the stopper 27 contacts a lower surface of the sheet contact plate 5.

The image forming apparatus 1 further includes an arm 6, a slider 7, and a spring 8.

The arm 6 may be a plate-shaped member. The arm 6 includes a third end portion 61 and a fourth end portion 62. The third end portion 61 may be located on one side of the arm 6 in a direction in which the arm 6 extends as viewed in the right-left direction (hereinafter, referred to as the arm extending direction). The fourth end portion 62 may be located on the other side of the arm 6 in the arm extending direction as viewed in the right-left direction. The arm 6 has a cutout portion in a middle of the fourth end portion 62. That is, the fourth end portion 62 consists of separate right and left portions located on opposite sides of the cutout portion.

The arm 6 includes support shafts 61*a* at the third end portion 61. The support shafts 61*a* protrude outward from right and left ends, respectively, of the arm 6 and extend in the right-left direction. The support shafts 61*a* have a common axis that may be a second axis C2 as their rotation center. The second axis C2 extends in the right-left direction. The support shafts 61*a* are rotatably engaged with the respective support holes 53*a* of the sheet contact plate 5. The third end portion 61 of the arm 6 is supported by the second end portion 52 of the sheet contact plate 5 through engagement of the support shafts 61*a* and the respective support holes 53*a* such that the arm 6 is pivotable about the second axis C2.

The fourth end portion 62 includes slide shafts 62*a* at the right and left portions, respectively. The slide shafts 62*a* extend toward each other from respective facing surfaces of the right and left portions of the fourth end portion 62 in the right-left direction. The slide shafts 62*a* have a common axis that may be a third axis C3 as their rotation center. The third axis C3 extends in the right-left direction.

The arm 6 is located closer to a central portion of the discharge tray 2A than each of the stiffening ribs 53 of the sheet contact plate 5 in the right-left direction extending along the first-axis direction. That is, the stiffening ribs 53 of the sheet contact plate 5 are positioned on opposite sides of the arm 6 in the right-left direction.

When the sheet contact plate 5 is located at the protruding position, the portion of the sheet contact plate 5 protrudes upward relative to the ribs 23. In this state, although a gap is formed between the sheet contact plate 5 and the upper ends of the ribs 23, the stiffening ribs 53 cover the gap to conceal the arm 6.

Such a configuration may thus improve appearance of the image forming apparatus 1.

The slider 7 has a substantially rectangular parallelepiped shape. The slider 7 is disposed in the recessed portion 24 so as to be slidable along the front-rear direction that extends along the sheet discharge direction.

The slider 7 includes guide rails 71 at its respective side surfaces 7*a*. The guide rails 71 protrude outward from the right and left side surfaces 7*a*, respectively, of the slider 7 and extend in the front-rear direction. The guide rails 71 are engaged with the respective guide grooves 25 in the recessed portion 24 so as to be slidable relative to the guide grooves 25. The guide grooves 25 and the guide rails 71 are configured to guide the slider 7 along the front-rear direction.

As described above, the image forming apparatus 1 includes the guide grooves 25 and the guide rails 71 that are engaged with the respective guide grooves 25 and slidable relative to the guide grooves 25. The guide grooves 25 and the guide rails 71 are configured to slide the slider 7 along the front-rear direction. Such a configuration may enable the slider 7 to slide smoothly along the front-rear direction.

In this example, the recessed portion 24 of the discharge tray 2A has the guide grooves 25 and the slider 7 includes the guide rails 71. Nevertheless, in another example, the slider 7 may have guide grooves and the recessed portion 24 of the discharge tray 2A may include guide rails.

The slider 7 further includes an arm support portion 7*b* at its front end portion. The arm support portion 7*b* is narrower than a rear end portion of the slider 7 in the right-left direction. The arm support portion 7*b* has elongated holes 72 in its right and left side surfaces, respectively. Each elongated hole 72 has one end 72*a* and the other end 72*b*. The one end 72*a* is located lower than the other end 72*b* in a direction in which a corresponding elongated hole 72 is elongated (hereinafter, referred to as the elongated direction). In the first illustrative embodiment, the elongated direction is parallel to the up-down direction.

The elongated holes 72 are engaged with the respective slide shafts 62*a* of the arm 6. Each slide shaft 62*a* is configured to slide between the one end 72*a* and the other end 72*b* in a corresponding elongated hole 72. Each slide shaft 62*a* is an example of a shaft engaged with an elongated hole.

The fourth end portion 62 of the arm 6 is supported by the slider 7 through engagement of the slide shafts 62*a* and the respective elongated holes 72 such that the arm 6 is pivotable about the third axis C3.

In this example, the slider 7 has the elongated holes 72 and the arm 6 includes the slide shafts 62*a*. Nevertheless, in another example, the arm 6 may have elongated holes and the slider 7 may include slide shafts.

The slider 7 has a recess 7*c* that is recessed toward the front relative to a rear surface of the slider 7.

The spring 8 may be a compressed coil spring. The spring 8 is disposed between the slider 7 and the rear wall 24*b* of the recessed portion 24. The spring 8 has a rear end portion engaged with the protrusion 26 of the rear wall 24*b* of the recessed portion 24. The rear end portion of the spring 8 is supported by the rear wall 24*b*. The spring 8 has a front end portion positioned in the recess 7*c* by insertion. The front end portion of the spring 8 is supported by the slider 7.

The spring 8 urges the slider 7 toward the front. That is, the slider 7 is urged away from the first axis C1 in the front-rear direction.

As the slider 7 moves toward the front by an urging force of the spring 8, the fourth end portion 62 of the arm 6 moves toward the front and the third end portion 61 of the arm 6 moves upward. Thus, as illustrated in FIG. 5A, the position of the arm 6 becomes an up position. In response to such movement, the sheet contact plate 5 upwardly pivots about the first axis C1 to stop at the protruding position. In a state where the sheet contact plate 5 is located at the protruding position and the arm 6 is in the up position, the third end portion 61 is located higher than the fourth end portion 62 in the arm 6.

In this state, the sheet contact plate 5 is held at the protruding position by the arm 6 supporting a portion of the sheet contact plate 5 closer to the second end portion 52 than to the first end portion 51. To achieve such holding, the second axis C2 that is the point to which a force is applied when the arm 6 holds the sheet contact plate 5 at the protruding position may be located at a position appropriately away from the first axis C1 that is the pivot center of the sheet contact plate 5.

Such a configuration may thus require a relatively small force for holding the sheet contact plate 5 at the protruding position. Thus, the spring 8 having a relatively small urging force may be used for holding the arm 6 in the up position by pressing the fourth end portion 62 of the arm 6 toward the front.

Consequently, such a configuration may relieve the sheet contact plate 5 of an excessive force via the arm 6, thereby reducing risk of deformation of the sheet contact plate 5.

When the sheet contact plate 5 is located at the protruding position, the arm 6 is in the up position that is closer to a vertical position rather than a horizontal position. Such an arm position may weaken a force acting on the slider 7 in the sliding direction when a downward force occurring from weights of discharged sheets S held by the upper surface of the sheet contact plate 5 on the discharge tray 2A acts on the arm 6 supporting the sheet contact plate 5. Consequently, the sheet contact plate 5 may be held at the protruding position using the spring 8 having a relatively small urging force.

When the sheet contact plate 5 is located at the protruding position, the arm 6 is preferably in a position such that an angle that a straight line connecting between the second axis C2 and the third axis C3 forms with the horizontal direction is greater than 45° and smaller than 90°. In the first illustrative embodiment, when the sheet contact plate 5 is located at the protruding position, the arm 6 is in a position such that an angle that the straight line connecting between the second axis C2 and the third axis C3 forms with the horizontal direction is 60°.

When the sheet contact plate 5 is located at the protruding position, the third axis C3 is located vertically below a straight line L1 connecting between the first axis C1 and the second axis C2. In response to the fourth end portion 62 of the arm 6 being urged toward the front by the urging force of the spring 8, the fourth end portion 62 of the arm 6 moves to and contacts the one ends 72*a* in the respective elongated holes 72 and the arm 6 attempts to pivot such that the third end portion 61 moves upward. Thus, the arm 6 exerts, on the sheet contact plate 5, a force acting in a direction in which the sheet contact plate 5 pivots upward.

Such a configuration may thus enable the sheet contact plate 5 to be held at the protruding position by the urging force of the spring 8 in the image forming apparatus 1.

The sheet contact plate 5 is held at the protruding position by the spring 8 urging the sheet contact plate 5 upward. This configuration allows the sheet contact plate 5 to move toward the retracted position against the urging force of the spring 8 in response to application of a predetermined downward force to the sheet contact plate 5.

For pulling one or more discharged sheets S toward the front to remove the one or more sheets S from the discharge tray 2A, such a configuration may enable a user to move the sheet contact plate 5 toward the retracted position from the protruding position against the urging force of the spring 8, thereby achieving easy removal of the one or more sheets S from the discharge tray 2A.

After the user removes the one or more sheets S from the discharge tray 2A, the sheet contact plate 5 is enabled to return to the protruding position by the urging force of the spring 8.

The sheet contact plate 5 is allowed to be located at the retracted position by pivoting downward from the protruding position. As illustrated in FIG. 5B, when the sheet contact plate 5 is located at the retracted position, the arm 6 is in a down position that is closer to the horizontal position rather than the vertical position. As the arm 6 changes to the down position, the arm 6 moves the slider 7 toward the rear against the urging force of the spring 8. Thus, in a state where the arm 6 is in the down position, the slider 7 is located at a rearward position. In a state where the sheet contact plate 5 is located at the retracted position and the arm 6 is in the down position, the third end portion 61 is located lower than the fourth end portion 62.

When the sheet contact plate 5 is located at the retracted position, the third axis C3 is located vertically above the straight line L1. In response to the fourth end portion 62 of the arm 6 being urged toward the front by the urging force of the spring 8, the fourth end portion 62 of the arm 6 moves to and contacts the other ends 72*b* in the respective elongated holes 72 and the arm 6 attempts to pivot such that the third end portion 61 moves downward. Thus, a force acting in a direction in which the sheet contact plate 5 pivots downward acts on the sheet contact plate 5 from the arm 6.

Such a configuration may thus enable the sheet contact plate 5 to be held at the retracted position by the urging force of the spring 8 in the image forming apparatus 1 without requiring any member or component, such as a hook, for holding the sheet contact plate 5 at the retracted position.

Operation of Sheet Contact Plate and Support Structure for Sheet Contact Plate According to First Illustrative Embodiment Referring to appropriate drawings, a description will be provided on operation of the sheet contact plate 5 and the support structure for the sheet contact plate 5 when the sheet contact plate 5 moves between the protruding position and the retracted position. The drawings may illustrate only one of plural same parts or components for convenience purposes. First, a description will be provided on operation of the sheet contact plate 5 when the sheet contact plate 5 moves from the protruding position to the retracted position.

As illustrated in FIG. 5A, when the sheet contact plate 5 is located at the protruding position, the slider 7 is located at a forward position by the urging force of the spring 8 and the arm 6 is in the up position. The third axis C3 of the fourth end portion 62 of the arm 6 is located below the straight line L1. In such a state, each slide shaft 62*a* of the fourth end portion 62 contacts the one end 72*a* in a corresponding elongated hole 72.

As the sheet contact plate 5 is pivoted downward about the first axis C1 by application of a downward force to the sheet contact plate 5, the third end portion 61 of the arm 6 moves downward and the fourth end portion 62 of the arm 6 presses the slider 7 toward the rear against the urging force of the spring 8.

Figure 6A:
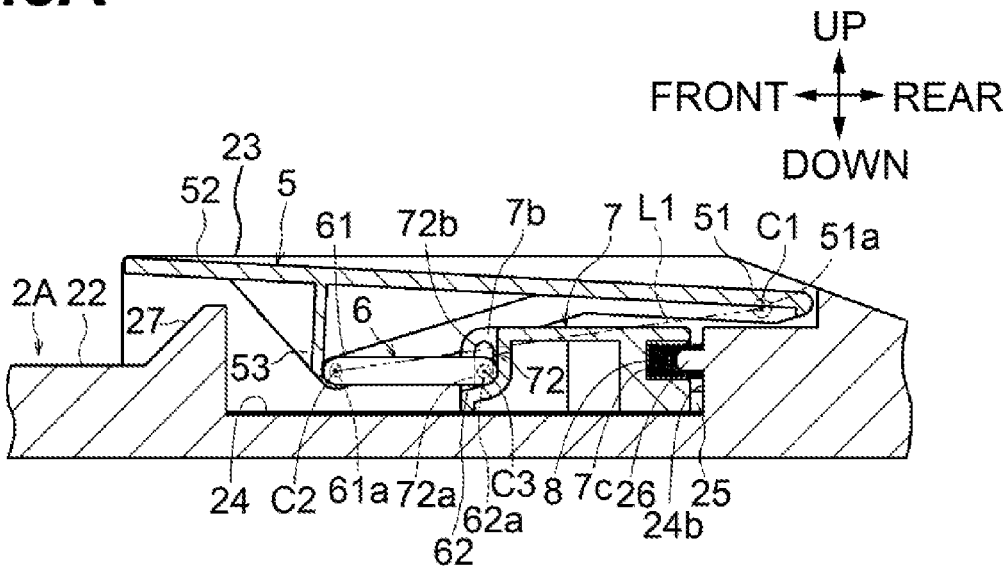
FIGS. 6A and 6B are sectional side views each illustrating the sheet contact plate and the support structure for the sheet contact plate taken along line A-A of FIG. 2 according to the first illustrative embodiment of the disclosure, and each explaining operation of the sheet contact plate and the support structure for the sheet contact plate while the sheet contact plate moves from the protruding position toward the retracted position.

As illustrated in FIG. 6A, when the second end portion 52 of the sheet contact plate 5 reaches the same level as the upper ends of the ribs 23, the arm 6 is in an almost horizontal position in which the third end portion 61 and the fourth end portion 62 are substantially at the same level.

In such a state, the third axis C3 is located vertically below the straight line L1, and the sheet contact plate 5 is subjected to a force that causes the sheet contact plate 5 to pivot upward due to the urging force of the spring 8. Thus, when the sheet contact plate 5 becomes free from the downward force, the sheet contact plate 5 is allowed to pivot upward by the urging force of the spring 8 to return to the protruding position.

Figure 6B:
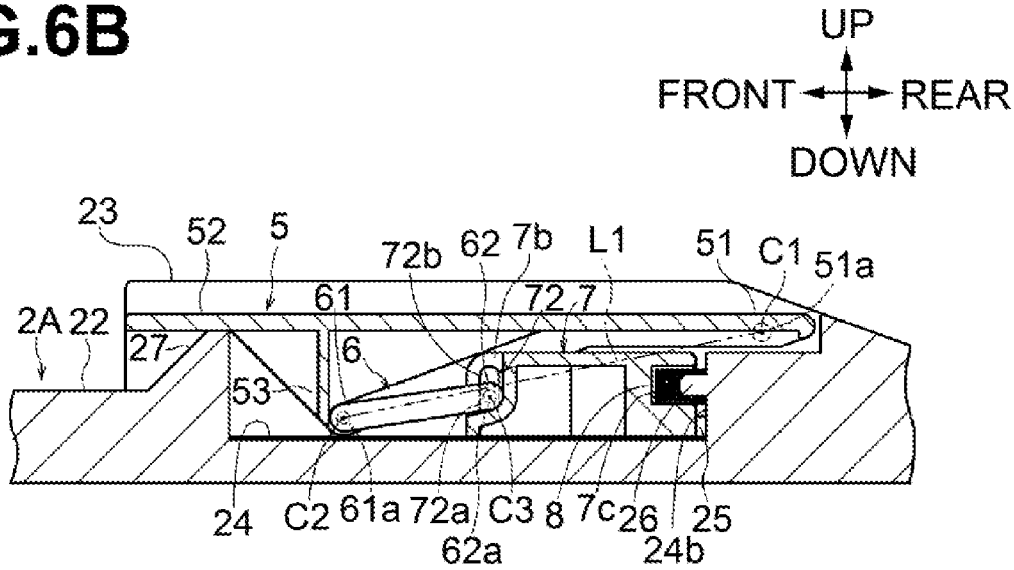

As the sheet contact plate 5 is pivoted further downward from the position of FIG. 6A, the second end position 52 of the sheet contact plate 5 moves below the upper ends of the ribs 23. As illustrated in FIG. 6B, when the second end portion 52 of the sheet contact plate 5 contacts the stopper 27, the sheet contact plate 5 stops and stays at the retracted position. In such a state, in the arm 6, the fourth end portion 62 is located higher than the third end portion 61.

In response to the spring 8 urging the fourth end portion 62 of the arm 6 toward the front while the arm 6 is in such a state, the fourth end portion 62 moves upward. More specifically, for example, each slide shaft 62*a* moves from the one end 72*a* to the other end 72*b* in a corresponding elongated hole 72. Thus, the sheet contact plate 5 and the arm 6 are in respective positions illustrated in FIG. 5B.

As illustrated in FIG. 5B, in a state where the sheet contact plate 5 is located at the retracted position and each slide shaft 62*a* contacts the other end 72*b* in a corresponding elongated hole 72, the third axis C3 of the slide shafts 62*a* is located vertically above the straight line L1.

Thus, the sheet contact plate 5 is subjected to a force that causes the sheet contact plate 5 to pivot downward due to the urging force of the spring 8. Such a configuration may thus enable the sheet contact plate 5 to be held at the retracted position without necessity of the downward force.

The slide shafts 62*a* of the fourth end portion 62 of the arm 6 are engaged with the respective elongated holes 72 of the slider 7. Each slide shaft 62*a* is slidable between the one end 72*a* and the other end 72*b* in a corresponding elongated hole 72. The arm 6 is configured such that the positional change of each slide shaft 62*a* between vertically above and vertically below the straight line L1 may be achieved by sliding of each slide shaft 62*a* between the one end 72*a* and the other end 72*b* in a corresponding elongated hole 72 in a state where the sheet contact plate 5 is located at the retracted position. Such a configuration may thus easily cause the positional change of each slide shaft 62*a* between vertically above and vertically below the straight line L1.

When the sheet contact plate 5 is located at the retracted position, the entirety of the sheet contact plate 5 is located lower than the upper ends of the ribs 23. Thus, in a case where a sheet S is discharged onto the discharge tray 2A when the sheet contact plate 5 is located at the retracted position, the discharged sheet S contacts and is held by the ribs 23.

As described above, a leading edge portion of the sheet S on the discharge tray 2A may be held by the ribs 23 even when the sheet contact plate 5 is located at the retracted position.

In the image forming apparatus 1, as illustrated in FIG. 6B, after the second end portion 52 of the sheet contact plate 5 reaches below the upper ends of the ribs 23, the third axis C3 moves from below to above the straight line L1.

As illustrated in FIG. 6A, when the second end portion 52 of the sheet contact plate 5 reaches the same level as the upper ends of the ribs 23 by a downward pivot of the sheet contact plate 5 from the protruding position to the retracted position, the sheet contact plate 5 is subjected to the force that causes the sheet contact plate 5 to pivot upward due to the urging force of the spring 8.

When a user pulls discharged sheets S toward the front to remove the sheets S from the discharge tray 2A, the sheets S may contact and move down the sheet contact plate 5 by their weight from the protruding position to the same level as the upper ends of the ribs 23. When the sheet contact plate 5 is located at the position where its second end portion 52 is positioned at the same level as the upper ends of the ribs 23 by a downward pivot of the sheet contact plate 5, the third axis C3 is, however, still located vertically below the straight line L1. Thus, the sheet contact plate 5 is allowed to return to the protruding position by the urging force of the spring 8 after the removal of the one or more sheets S.

As described above, even when the sheet contact plate 5 is pressed downward for removal of the one or more discharged sheets S from the discharge tray 2A, the sheet contact plate 5 is enabled to automatically return to the protruding position without requiring any operation for pivoting the sheet contact plate 5 upward.

A description will be provided on operation of the sheet contact plate 5 and the support structure for the sheet contact plate 5 when the sheet contact plate 5 moves from the retracted position to the protruding position.

As the sheet contact plate 5 is pivoted upward about the first axis C1 by application of an upward force to the sheet contact plate 5 located at the retracted position illustrated in FIG. 5B, the third end portion 61 of the arm 6 moves upward. In response to the third end portion 61 of the arm 6 becoming higher than the fourth end portion 62 (refer to FIG. 7), the fourth end portion 62 that is urged toward the front by the urging force of the spring 8 moves downward and each slide shaft 62*a* moves from the other end 72*b* to the one end 72*a* in a corresponding elongated hole 72.

Figure 7:
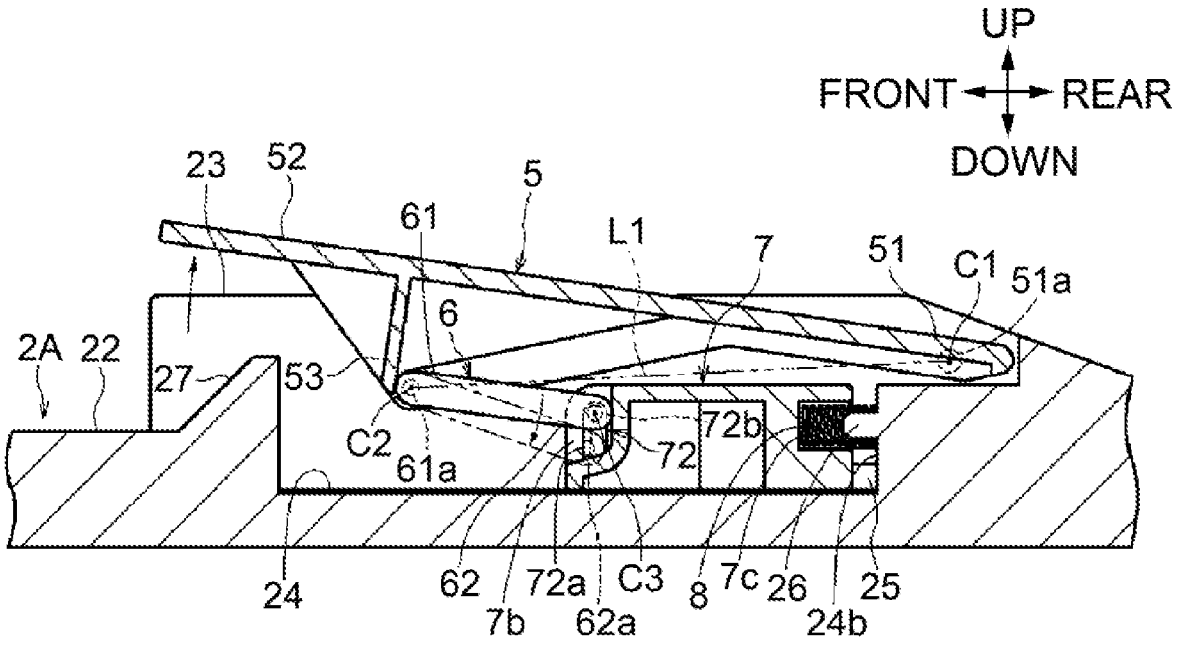
FIG. 7 is a sectional side view illustrating the sheet contact plate and the support structure for the sheet contact plate taken along line A-A of FIG. 2 according to the first illustrative embodiment of the disclosure, and explaining operation of the sheet contact plate and the support structure for the sheet contact plate while the sheet contact plate moves from the retracted position toward the protruding position.
Figure 8:
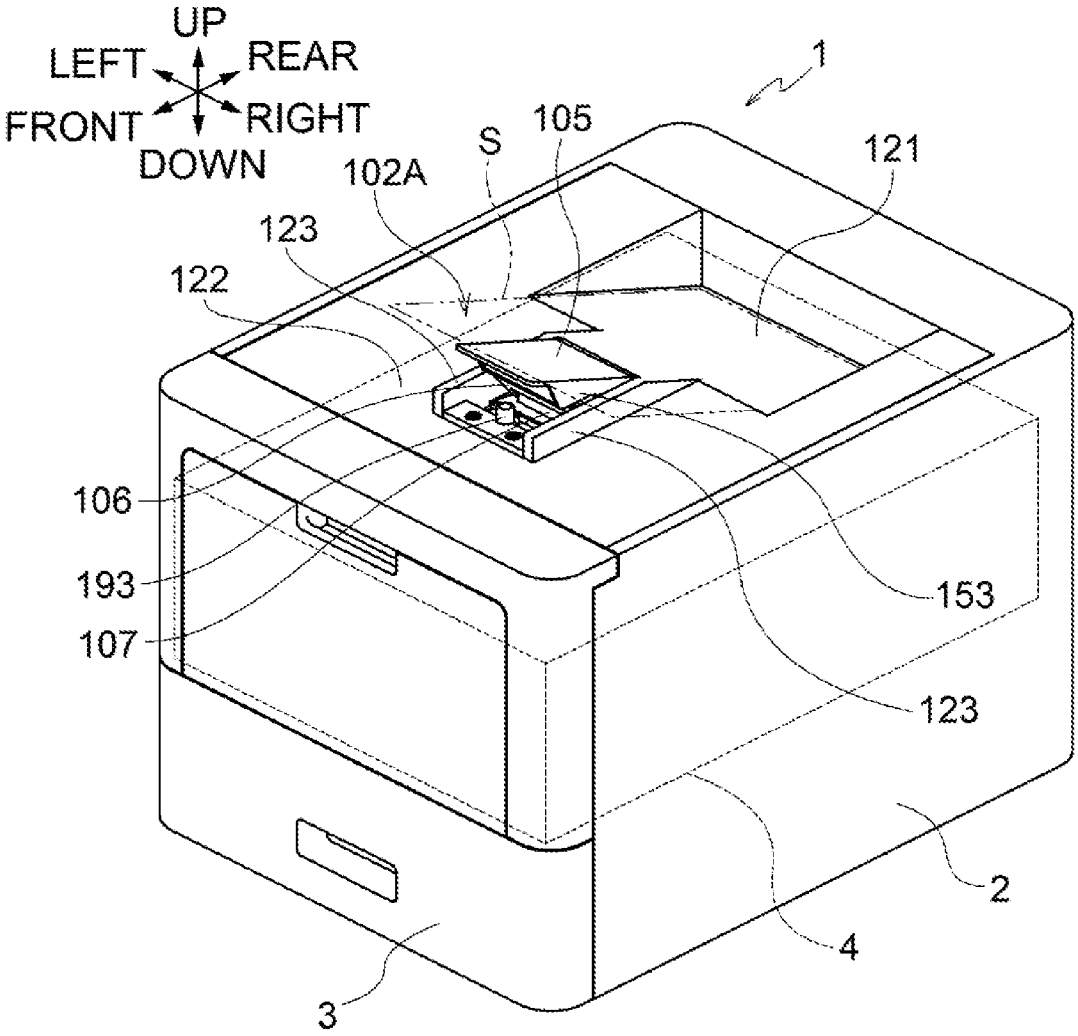
FIG. 8 is a perspective view of an image forming apparatus according to a second illustrative embodiment of the disclosure.
Figure 9:
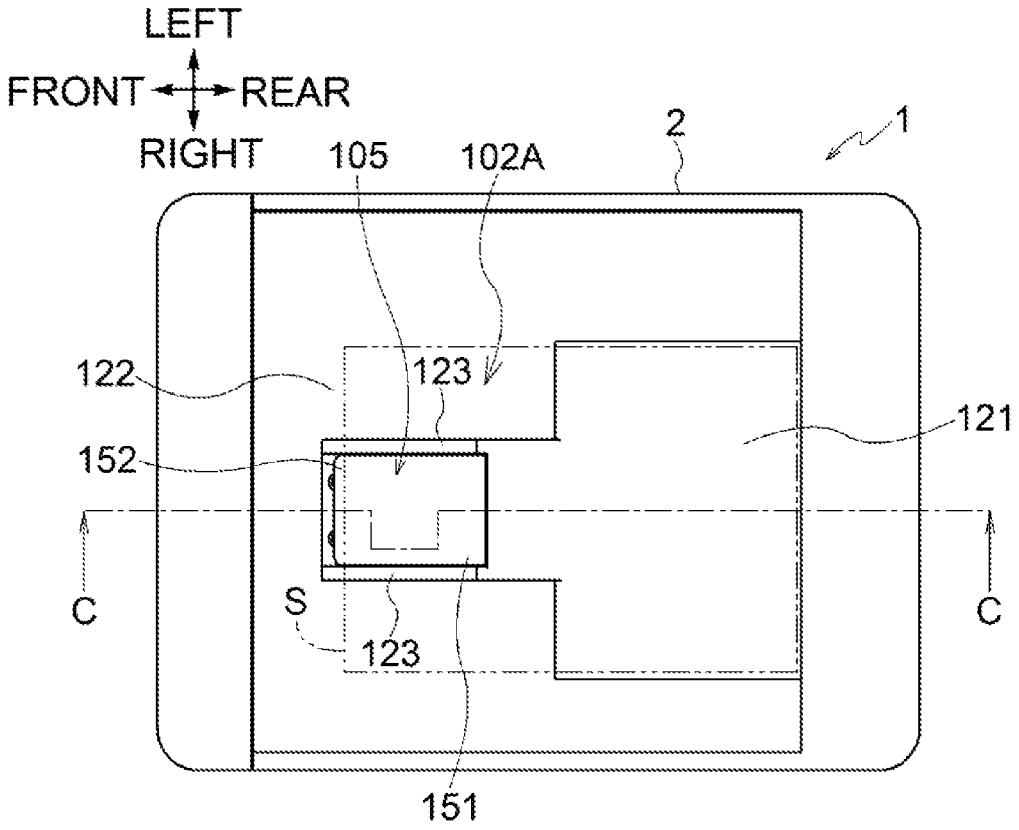
FIG. 9 is a plan view of the image forming apparatus according to the second illustrative embodiment of the disclosure.
Figure 10:
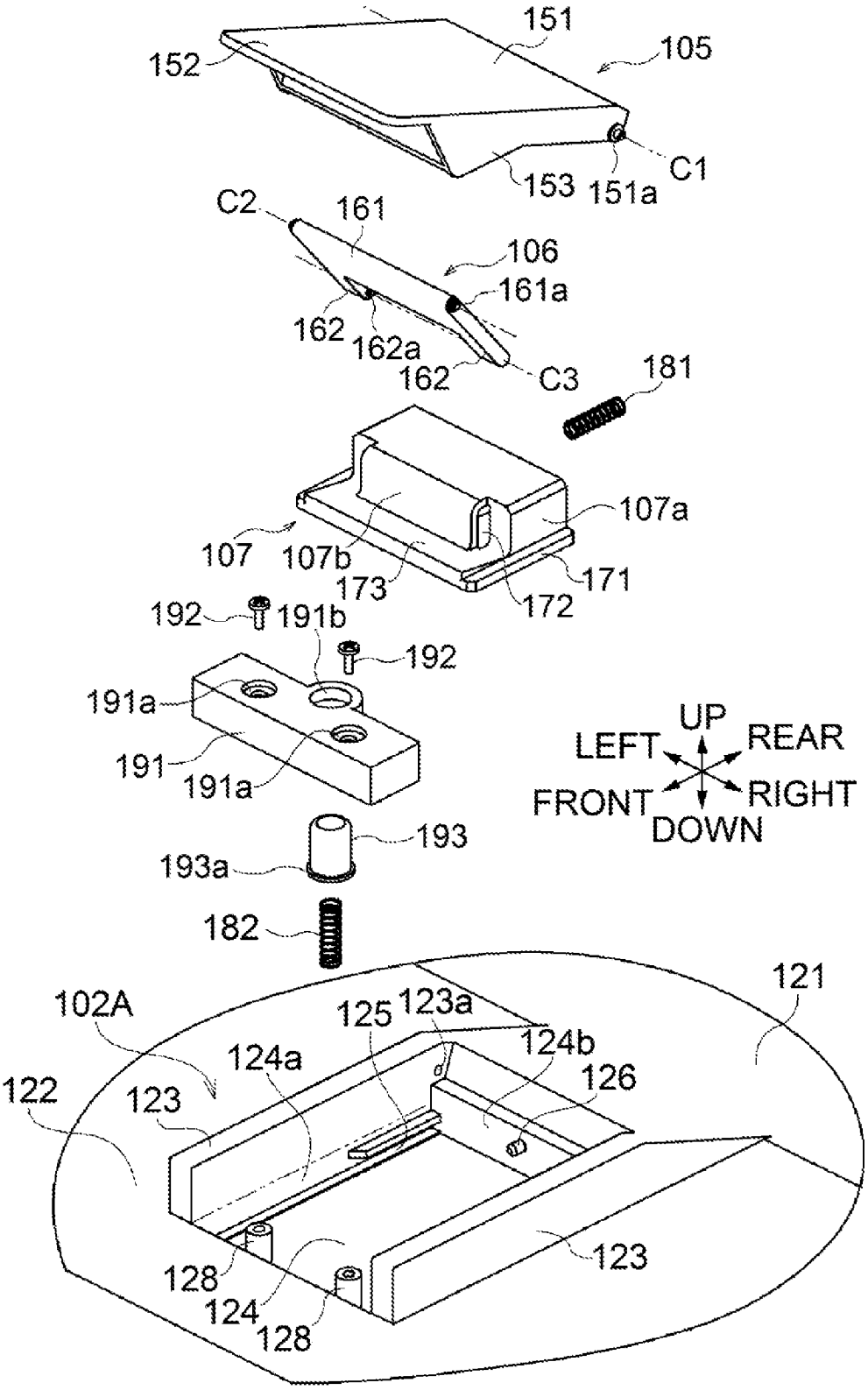
FIG. 10 is a disassembled perspective view of a sheet contact plate and a support structure for the sheet contact plate according to the second illustrative embodiment of the disclosure.
Figure 11:
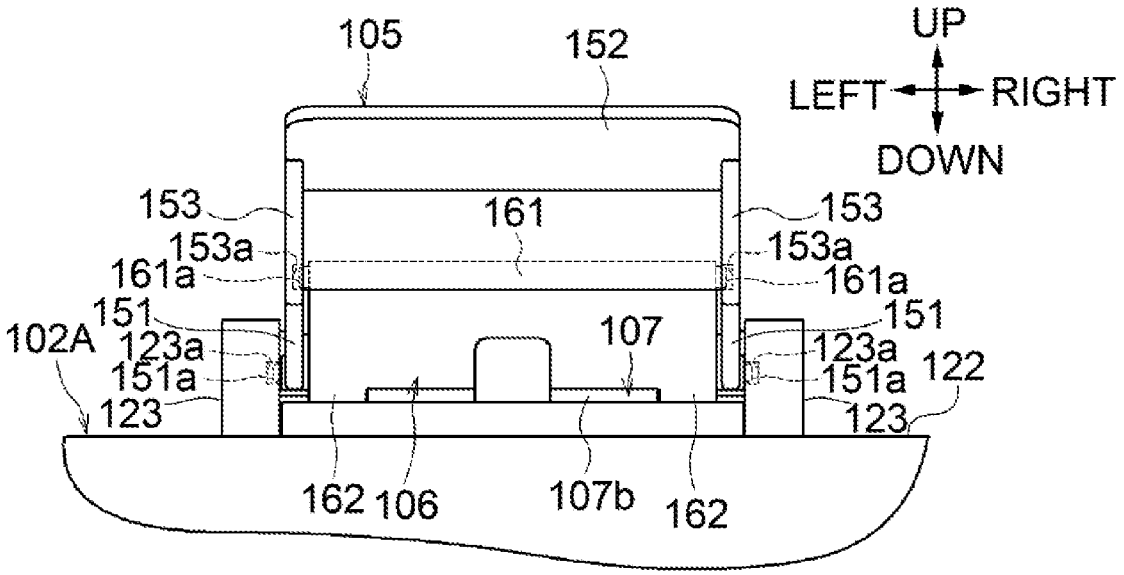
FIG. 11 is a front view of the sheet contact plate and the support structure for the sheet contact plate according to the second illustrative embodiment of the disclosure.

In the state illustrated in FIG. 7, the third axis C3 of the slide shafts 62*a* is located vertically below the straight line L1.

In this state, the sheet contact plate 5 is subjected to the force that causes the sheet contact plate 5 to pivot upward due to the urging force of the spring 8 and thus is pivoted upward to the protruding position (refer to FIG. 5A) by the upward force.

As described above, moving the sheet contact plate 5 from the retracted position to the protruding position may only require pivoting the sheet contact plate 5 upward until the third end portion 61 becomes higher than the fourth end portion 62. Changing the sheet contact plate 5 from the retracted position to the protruding position may be thus a simple operation.

A second illustrative embodiment will be described mainly with different points from the first illustrative embodiment. A description will be given mainly for the components or elements different from the first illustrative embodiment, and a description will be omitted for the common components or elements by assigning the same reference numerals thereto.

Sheet Contact Plate and Support Structure for Sheet Contact Plate According to Second Illustrative Embodiment A description will be provided on a sheet contact plate 105 and a support structure for the sheet contact plate 105 according to a second illustrative embodiment.

As illustrated in FIGS. 8, 9, 10, 11, 12A, and 12B, the sheet contact plate 105 is disposed at a discharge tray 102A. The discharge tray 102A is provided at the top of a housing 2 of an image forming apparatus 1.

The discharge tray 102A includes an inclined surface portion 121 and a horizontal surface portion 122. The inclined surface portion 121 extends diagonally upward toward the front from a rear end portion of the housing 2. The horizontal surface portion 22 is located in front of the inclined surface portion 21.

The sheet contact plate 105 is disposed at the horizontal surface portion 122. The sheet contact plate 105 is contactable with one or more discharged sheets S on the discharge tray 102A.

In sheet discharge onto the discharge tray 102A, a sheet S may first contact the inclined surface portion 121 that may be a rear part of the discharge tray 102A, and then a leading edge portion of the sheet S may reach and contact the sheet contact plate 105 disposed at the horizontal surface portion 122. The sheet contact plate 105 may restrict the movement of sheets S, thereby reducing risk of the sheets S falling from the discharge tray 102A and enabling alignment of the sheets S on the discharge tray 102A.

The sheet contact plate 105 includes a first end portion 151 and a second end portion 152. The first end portion 151 may be located on the rear side. The second end portion 52 may be located on the front side. The rear side according to the second illustrative embodiment is also an example of the upstream side in the sheet discharge direction. The front side according to the second illustrative embodiment is also an example of the downstream side in the sheet discharge direction.

The sheet contact plate 105 is supported by the horizontal surface portion 122 of the discharge tray 102A such that the sheet contact plate 105 is pivotable about a first axis C1. The first axis C1 is located at the first end portion 151. The sheet contact plate 105 includes pivot shafts 151*a* at the first end portion 151. The pivot shafts 151*a* protrude outward from right and left ends, respectively, of the sheet contact plate 105 and extend in the right-left direction. The pivot shafts 151*a* have a common axis that may be the first axis C1 as their rotation center.

The discharge tray 102A further includes a pair of ribs 123. The ribs 123 are elongated in the front-rear direction and protrude upward from the horizontal surface portion 122. The ribs 123 are spaced from each other by a predetermined distance in the right-left direction. The ribs 123 have respective inner surfaces facing each other. Each rib 123 has an engagement hole 123*a* in its inner surface. Each engagement hole 123*a* is located at a rear end portion of a corresponding rib 123. Each engagement hole 123*a* is engaged with a corresponding pivot shaft 151*a* of the sheet contact plate 105 and allows the corresponding pivot shaft 151*a* to rotate therein. The sheet contact plate 105 is supported by the discharge tray 102A through the engagement of the pivot shafts 151*a* and the respective engagement holes 123*a* such that the sheet contact plate 105 is pivotable about the first axis C1.

The sheet contact plate 105 is disposed between the ribs 123 in the right-left direction. That is, the ribs 123 are located on opposite sides (e.g., one side and the other side) of the sheet contact plate 105 in a direction in which the first axis C1 extends (hereinafter, referred to as the first-axis direction), and are elongated in the front-rear direction perpendicular to the first-axis direction.

Figure 12A:
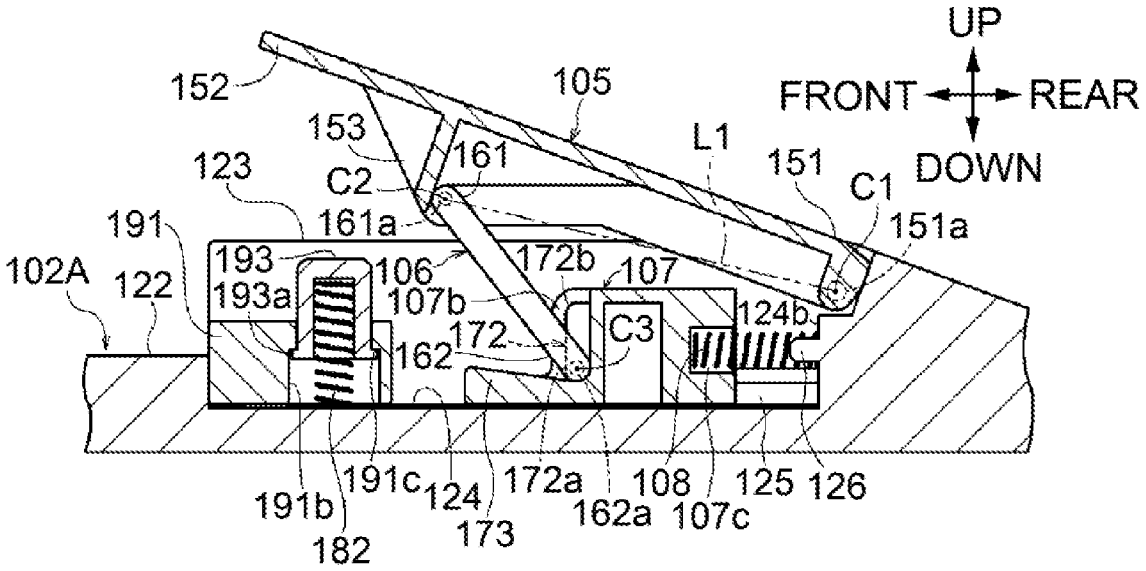
FIG. 12A is a sectional side view of the sheet contact plate and the support structure for the sheet contact plate taken along line C-C of FIG. 9 according to the second illustrative embodiment of the disclosure, wherein the sheet contact plate is located at a protruding position.
Figure 12B:
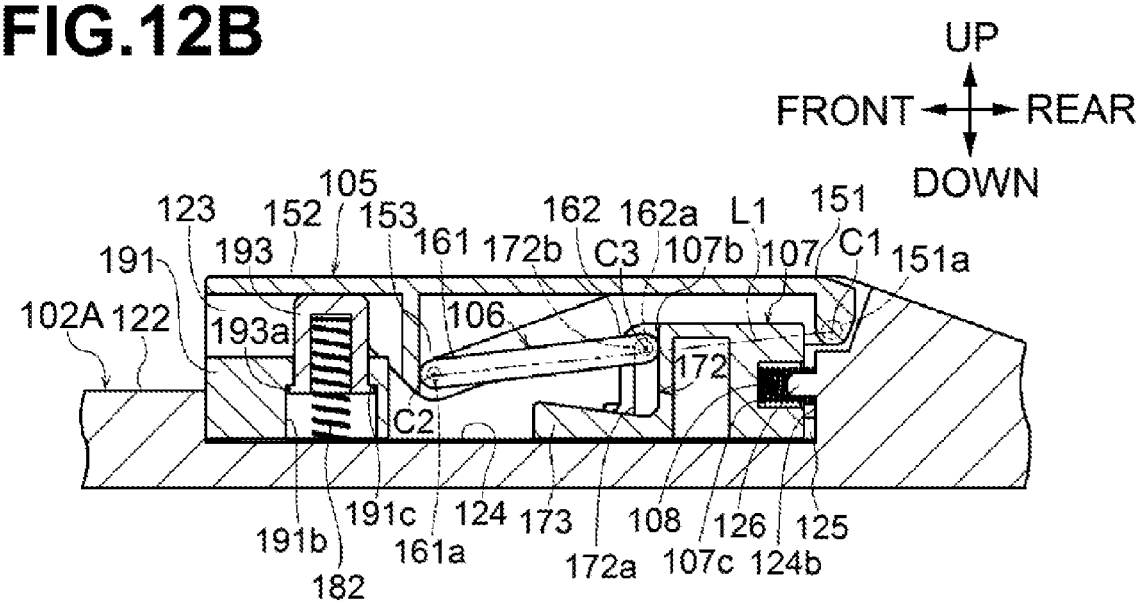
FIG. 12B is a sectional side view of the sheet contact plate and the support structure for the sheet contact plate taken along line C-C of FIG. 9 according to the second illustrative embodiment of the disclosure, wherein the sheet contact plate is located at a retracted position.

The sheet contact plate 105 is configured to move between a retracted position and a protruding position by pivoting about the first axis C1. As illustrated in FIG. 12B, when the sheet contact plate 5 is located at the retracted position, an upper surface of the sheet contact plate 5 is coplanar with upper ends of the ribs 123 (only one of the ribs 123 is illustrated in FIG. 12B). As illustrated in FIG. 12A, when the sheet contact plate 105 is located at the protruding position, a portion of the sheet contact plate 5 protrudes upward relative to the upper ends of the ribs 123 (only one of the ribs 123 is illustrated in FIG. 12A). When the sheet contact plate 105 is located at the protruding position, the sheet contact plate 105 may contact a sheet S held by the discharge tray 102A. When the sheet contact plate 105 is located at the retracted position, the sheet contact plate 105 extends parallel to the horizontal surface portion 122.

The sheet contact plate 105 further includes stiffening ribs 153. The stiffening ribs 153 extend from the right and left ends, respectively, of the sheet contact plate 105 toward the discharge tray 102A. The stiffening ribs 153 are shaped like a triangle having a vertex angle at its lower end. The stiffening ribs 153 have respective inner surfaces facing each other. Each stiffening rib 153 has a support hole 153*a* in its inner surface. The support hole 153*a* is located close to the vertex angle of each stiffening rib 153. The support holes 153*a* are located closer to the second end portion 152 than to the first end portion 151 of the sheet contact plate 105 in the front-rear direction.

The discharge tray 102A further includes a recessed portion 124 between the right and left ribs 123. The recessed portion 124 is recessed downward relative to the horizontal surface portion 122. The recessed portion 124 has side walls 124*a* defining its right and left ends and a rear wall 124*b* defining its rear end. The rear wall 124*b* is positioned further to the front than the engagement holes 123*a* of the ribs 123.

Each side wall 124*a* has a guide groove 125 extending along the sheet discharge direction. The rear wall 124*b* includes a protrusion 126 protruding toward the front.

The recessed portion 124 further includes pins 128 extending upward from a front end portion of a bottom surface of the recessed portion 124. The pins 128 each have an internal thread formed in the up-down direction. The pins 128 are located at respective positions and next to each other in the right-left direction.

In the second illustrative embodiment, the image forming apparatus 1 further includes an arm 106, a slider 107, a first spring 181, a second spring 182, a base member 191, and a push-back member 193.

The arm 106 may be a plate-shaped member. The arm 6 includes a third end portion 161 and a fourth end portion 162. The third end portion 161 may be located on one side of the arm 106 in a direction in which the arm 106 extends as viewed in the right-left direction (hereinafter, referred to as the arm extending direction). The fourth end portion 162 may be located on the other side of the arm 106 in the arm extending direction as viewed in the right-left direction. The arm 106 has a cutout portion in a middle of the fourth end portion 162. That is, the fourth end portion 162 consists of separate right and left portions located on opposite sides of the cutout portion.

The arm 106 includes support shafts 161*a* at the third end portion 161. The support shafts 161*a* protrude outward from right and left ends, respectively, of the arm 106 and extend in the right-left direction. The support shafts 161*a* have a common axis that may be a second axis C2 as their rotation center. The second axis C2 extends in the right-left direction. The support shafts 161*a* are rotatably engaged with the respective support holes 153*a* of the sheet contact plate 105. The third end portion 161 of the arm 106 is supported by the second end portion 152 of the sheet contact plate 105 through engagement of the support shafts 161*a* and the respective support holes 153*a* such that the arm 106 is pivotable about the second axis C2.

The fourth end portion 162 includes slide shafts 162*a* at the right and left portions, respectively. The slide shafts 162*a* extend toward each other from respective facing surfaces of the right and left portions of the fourth end portion 162 in the right-left direction. The slide shafts 162*a* have a common axis that may be a third axis C3 as their rotation center. The third axis C3 extends in the right-left direction.

As with the arm 6, the arm 106 is located closer to a central portion of the discharge tray 102A than each of the stiffening ribs 153 of the sheet contact plate 105 is to the central portion in the right-left direction.

That is, the arm 106 is disposed between the stiffening ribs 153 and is covered and concealed by the stiffening ribs 153. Such a configuration may thus improve appearance of the image forming apparatus 1.

The slider 107 has a substantially rectangular parallelepiped shape. The slider 107 is disposed in the recessed portion 124 so as to be slidable along the front-rear direction that extends along the sheet discharge direction. The slider 107 includes guide rails 171 at its respective side surfaces 107*a*. The guide rails 171 protrude outward from the right and left side surfaces 107*a*, respectively, of the slider 107 and extend in the front-rear direction. The guide rails 171 are engaged with the respective guide grooves 125 in the recessed portion 124 and slidable relative to the guide grooves 125. The guide grooves 125 and the guide rails 171 are configured to guide the slider 107 along the front-rear direction. Such a configuration may enable the slider 107 to slide smoothly along the front-rear direction.

Nevertheless, in another example, the slider 107 may have guide grooves and the recessed portion 124 of the discharge tray 102A may include guide rails.

The slider 107 further includes an arm support portion 107*b* at its front end portion. The arm support portion 107*b* is narrower than a rear end portion of the slider 107 in the right-left direction. The arm support portion 107*b* has elongated holes 172 in its right and left side surfaces, respectively. Each elongated hole 172 has one end 172*a* and the other end 172*b*. The one end 172*a* is located lower than the other end 172*b* in a direction in which a corresponding elongated hole 172 is elongated (hereinafter, referred to as the elongated direction). In the second illustrative embodiment, the elongated direction is parallel to the up-down direction.

The elongated holes 172 are engaged with the respective slide shafts 162*a* of the arm 106. Each slide shaft 162*a* is configured to slide between the one end 172*a* and the other end 172*b* in a corresponding elongated hole 172. Each slide shaft 162*a* is another example of the shaft engaged with the elongated hole.

The fourth end portion 162 of the arm 106 is supported by the slider 107 through engagement of the slide shafts 162*a* and the respective elongated holes 172 such that the arm 106 is pivotable about the third axis C3.

Nevertheless, in another example, the arm 106 may have elongated holes and the slider 107 may include slide shafts.

The slider 107 includes a contact portion 173 that protrudes toward the front from a lower portion of the arm support portion 107*b*. The contact portion 173 is configured to, while the sheet contact plate 105 moves from the protruding position toward the retracted position, contact the arm 106 from below. The arm 106 is configured to, in response to the third end portion 161 of the arm 106 moving downward while the arm 106 is in contact with the contact portion 173 of the slider 107, pivot about the third axis C3 to move the fourth end portion 162 upward relative to the third end portion 161.

The slider 107 has a recess 107*c* that is recessed toward the front relative to a rear surface of the slider 107. The first spring 181 may be a compressed coil spring. The first spring 181 is disposed between the slider 107 and the rear wall 124*b* of the recessed portion 124. The first spring 181 has a rear end portion engaged with the protrusion 126 of the rear wall 124*b* of the recessed portion 124. The rear end portion of the spring 181 is supported by the rear wall 124*b*. The first spring 181 has a front end portion positioned in the recess 107*c* by insertion. The front end portion of the spring 181 is supported by the slider 107. The first spring 181 urges the slider 107 away from the first axis C1 in the front-rear direction.

The base member 191 is disposed at the front end portion of the recessed portion 124 of the discharge tray 102A. The base member 191 has through holes 191*a* each penetrating therethrough in the up-down direction. The through holes 191*a* are engaged with the respective pins 128 by insertion. The base member 191 is fastened to the recessed portion 124 by screws 192 screwed into the inner screws of the respective pins 128 engaged with the through holes 191*a*.

The base member 191 further includes a slidable portion 191*b* at its middle portion in the right-left direction. The slidable portion 191*b* may be a hollow and penetrate the base member 191 in the up-down direction. The push-back member 193 has a hollow cylindrical shape with an upper end closed. The push-back member 193 is engaged with the slidable portion 191*b* so as to be slidable in the up-down direction relative to the slidable portion 191*b*. The slidable portion 191*b* extends in the up-down direction. The slidable portion 191*b* includes an upper portion and a lower portion. In the slidable portion 191*b*, a diameter of the upper portion is smaller than a diameter of the lower portion. The slidable portion 191*b* includes a stepped portion 191*c* between the upper portion and the lower portion.

The push-back member 193 includes a flange 193*a* at its lower end. The flange 193*a* protrudes outward in a radial direction from an outer circumferential surface of the push-back member 193. The push-back member 193 is configured such that, while the push-back member 193 slides upward relative to the slidable portion 191*b*, the flange 193*a* comes into engagement with the stepped portion 191*c* to stop further upward movement of the push-back member 193. The position where the push-back member 193 stops moving upward in the up-down direction corresponds to a position where a lower surface of the sheet contact plate 105 contacts the upper end of the push-back member 193 when the sheet contact plate 105 is located at the retracted position.

The second spring 182 is positioned between the push-back member 193 and the bottom surface of the recessed portion 124. The second spring 182 urges the push-back member 193 upward. Thus, the push-back member 193 is movable to the position where the flange 193*a* of the push-back member 193 and the stepped portion 191*c* are engaged with each other, by an urging force of the second spring 182.

As the slider 107 moves toward the front by an urging force of the first spring 181, the fourth end portion 162 of the arm 106 moves toward the front and the third end portion 161 of the arm 106 moves upward. Thus, as illustrated in FIG. 12A, the arm 106 becomes an up position. In response to such movement, the sheet contact plate 105 upwardly pivots about the first axis C1 to the protruding position. In a state where the sheet contact plate 105 is located at the protruding position and the arm 106 is in the up position, the third end portion 161 is located higher than the fourth end portion 162 in the arm 106.

In this state, the sheet contact plate 105 is held at the protruding position by the arm 106 supporting a portion of the sheet contact plate 105 closer to the second end portion 152 than to the first end portion 151. To achieve such holding, the second axis C2 that is the point to which a force is applied when the arm 106 holds the sheet contact plate 105 at the protruding position may be located at a position appropriately away from the first axis C1 that is the pivot center of the sheet contact plate 105. Such a configuration may thus require a relatively small force for holding the sheet contact plate 105 at the protruding position. Thus, the first spring 181 having a relatively small urging force may be used, thereby reducing risk of deformation of the sheet contact plate 105.

When the sheet contact plate 105 is located at the protruding position, the third axis C3 is located vertically below a straight line L1 connecting between the first axis C1 and the second axis C2. With this configuration, the arm 106 may exert, on the sheet contact plate 105, a force that causes the sheet contact plate 105 to pivot upward due to the urging force of the first spring 181, thereby enabling holding of the sheet contact plate 105 at the protruding position.

As is the case with the first illustrative embodiment, for pulling one or more discharged sheets S toward the front to remove the one or more sheets S from the discharge tray 102A, such a configuration may enable the user to move the sheet contact plate 105 toward the retracted position from the protruding position against the urging force of the first spring 181, thereby achieving easy removal of the one or more sheets S from the discharge tray 102A.

After the user removes the one or more sheets S from the discharge tray 102A, the sheet contact plate 105 is enabled to return to the protruding position by the urging force of the first spring 108.

As illustrated in FIG. 12B, when the sheet contact plate 105 is located at the retracted position, the arm 106 is in a down position that is closer to the horizontal position rather than the vertical position. As the arm 106 changes to the down position, the arm 106 moves the slider 107 toward the rear against the urging force of the first spring 181. Thus, in a state where the arm 106 is in the down position, the slider 107 is located at a rearward position. In a state where the sheet contact plate 105 is located at the retracted position and the arm 106 is in the down position, the third end portion 161 is located lower than the fourth end portion 162.

When the sheet contact plate 105 is located at the retracted position, the third axis C3 is located vertically above the straight line L1. With this configuration, the arm 106 may exert, on the sheet contact plate 105, a downward force that causes the sheet contact plate 105 to pivot downward due to the urging force of the first spring 181, thereby enabling holding of the sheet contact plate 105 at the retracted position.

Operation of Sheet Contact Plate and Support Structure for Sheet Contact Plate According to Second Illustrative Embodiment Referring to appropriate drawings, a description will be provided on operation of the sheet contact plate 105 and the support structure for the sheet contact plate 105 when the sheet contact plate 105 moves between the protruding position and the retracted position. The drawings may illustrate only one of plural same parts or components for convenience purposes. First, a description will be provided on operation of the sheet contact plate 105 when the sheet contact plate 105 moves from the protruding position to the retracted position.

As illustrated in FIG. 12A, when the sheet contact plate 105 is located at the protruding position, the slider 107 is located at a forward position by the urging force of the first spring 181 and the arm 106 is in the up position. The third axis C3 of the fourth end portion 162 of the arm 106 is located below the straight line L1. In such a state, each slide shaft 162*a* of the fourth end portion 162 contacts the one end 172*a* in a corresponding elongated hole 172.

As the sheet contact plate 105 is pivoted downward about the first axis C1 by application of a downward force to the sheet contact plate 105, the third end portion 161 of the arm 106 moves downward and the fourth end portion 162 of the arm 106 presses the slider 107 toward the rear against the urging force of the first spring 181.

Figure 13A:
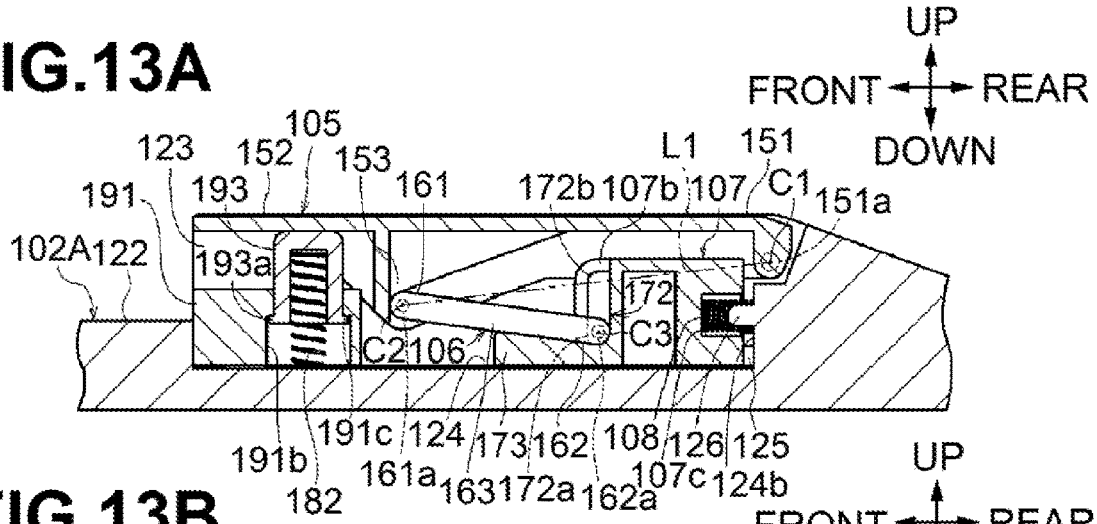
FIGS. 13A, 13B, 13C, and 13D are sectional side views each illustrating the sheet contact plate and the support structure for the sheet contact plate taken along line C-C of FIG. 9 according to the second illustrative embodiment of the disclosure, and each explaining operation of the sheet contact plate and the support structure for the sheet contact plate while the sheet contact plate moves from the protruding position toward the retracted position.

As illustrated in FIG. 13A, when the upper surface of the sheet contact plate 105 reaches the same level as the upper ends of the ribs 123, the sheet contact plate 105 extends parallel to the horizontal surface portion 122. In such a state, the lower surface of the sheet contact plate 105 contacts the upper end of the push-back member 193. The lower surface of the arm 106 entirely contacts the contact portion 173 of the slider 107 in the right-left direction. In such a state, in the arm 106, the third end portion 161 is located higher than the fourth end portion 162.

Figure 13B:
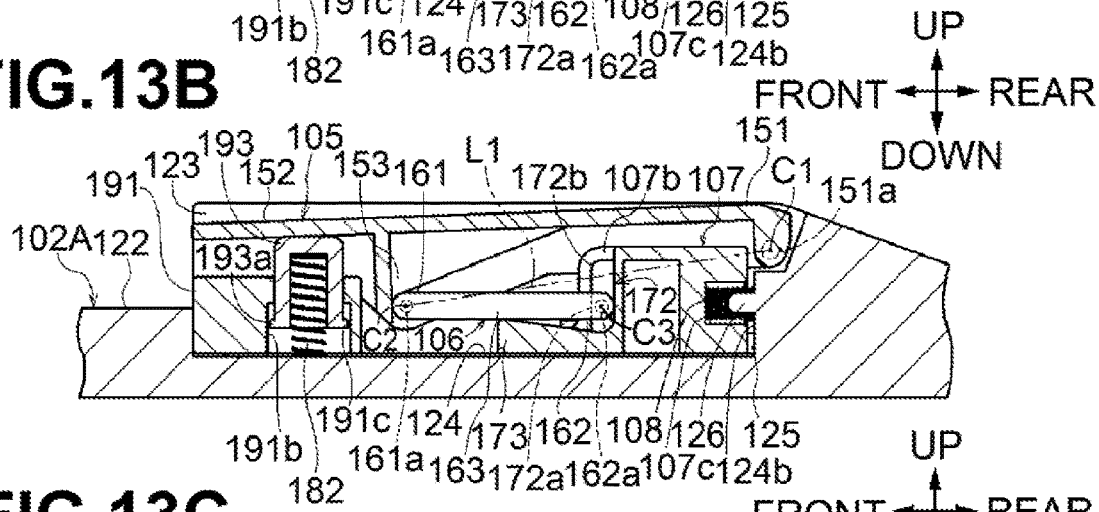

As the sheet contact plate 105 pivots further downward from the position of FIG. 13A, the upper surface of the sheet contact plate 105 becomes lower than the upper ends of the ribs 123 (refer to FIG. 13B). The third end portion 161 of the arm 106 also moves downward correspondingly and thus a contactable portion 163 of the arm 106 is pressed upward by the contact portion 173 of the slider 107 (refer to FIG. 13B). The arm 106 includes the contactable portion 163 between the third end portion 161 and the fourth end portion 162. In response to the contactable portion 163 of the arm 106 being pressed by the contact portion 173 of the slider 107, the fourth end portion 162 of the arm 106 moves upward by the pivot of the arm 106 about the second axis C2.

Thus, each slide shaft 162*a* of the fourth end portion 162 slide from the one end 172*a* toward the other end 172*b* in a corresponding elongated hole 172. The sheet contact plate 105 presses downward the push-back member 193 against the urging force of the second spring 182.

In the state illustrated in FIG. 13B, the arm 106 is in an almost horizontal position in which the third end portion 161 and the fourth end portion 162 are substantially at the same level. In this example, the slider 107 includes the contact portion 173 that is contactable with the arm 106. Nevertheless, in another example, the recessed portion 124 of the discharge tray 12A may include such a contact portion that may protrude upward from the bottom of the recessed portion 124.

Figure 13C:
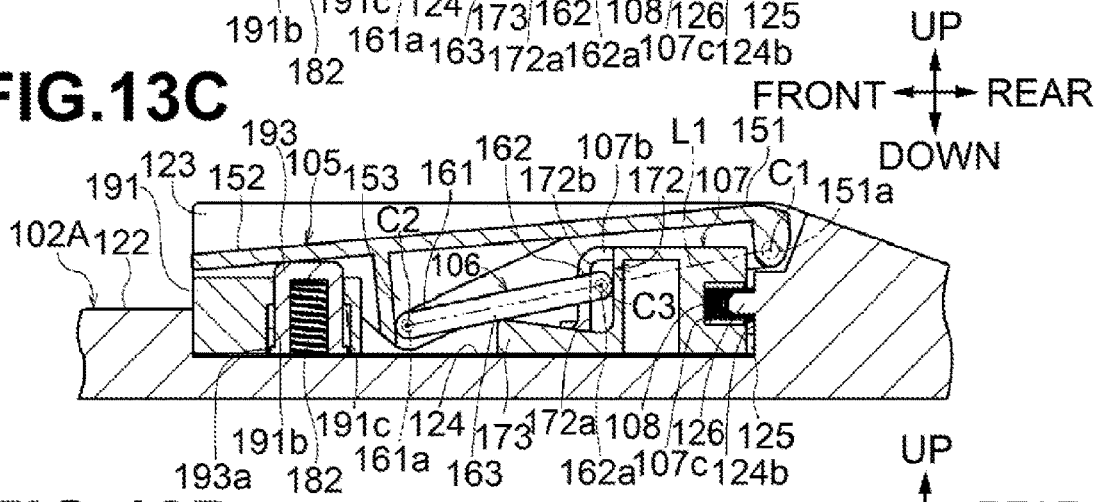

In response to the sheet contact plate 105 pivoting further downward from the position of FIG. 13B, the sheet contact plate 105 reaches a descended position that is lower than the retracted position (refer to FIG. 13C). When the sheet contact plate 105 is located at the descended position, the fourth end portion 162 is located higher than the third end portion 161 in the arm 106.

In response to the first spring 181 urging the fourth end portion 162 of the arm 106 toward the front while the arm 106 is in such a state, the fourth end portion 162 moves upward. More specifically, for example, each slide shaft 162*a* moves to the other end 172*b* in a corresponding elongated hole 172. Thus, the sheet contact plate 105 and the arm 106 are in respective positions illustrated in FIG. 13D.

Figure 13D:
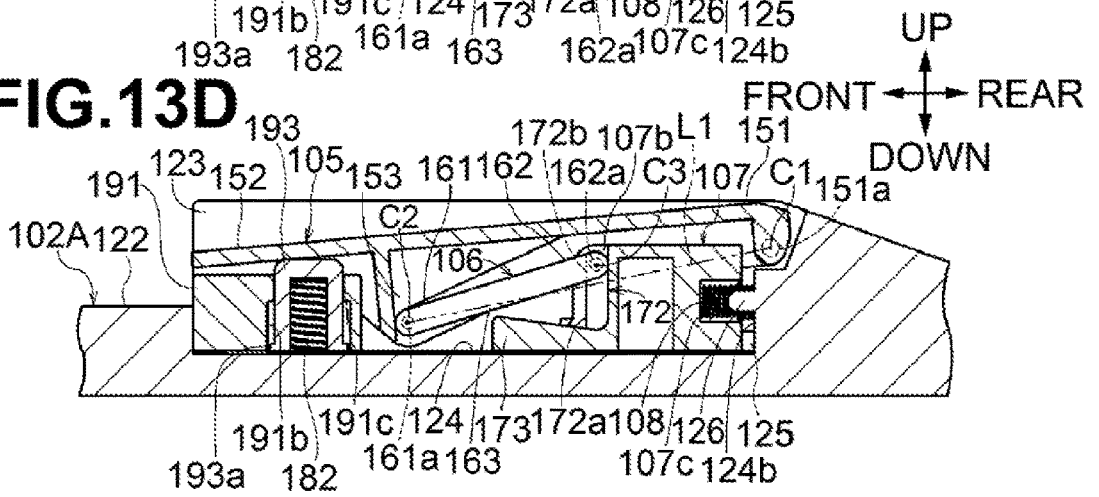

As illustrated in FIG. 13D, in a state where the sheet contact plate 105 is located at the descended position and each slide shaft 162*a* contacts the other end 172*b* in a corresponding elongated hole 172, the third axis C3 of the slide shafts 162*a* is located vertically above the straight line L1.

Thus, the sheet contact plate 105 is subjected to the downward force that causes the sheet contact plate 105 to pivot downward in such a state. At the same time, the sheet contact plate 105 contacts the push-back member 193 and thus is subjected to an upward force generated by the urging force of the second spring 182 via the push-back member 193. The push-back member 193 is an example of an urging member that upwardly urges the sheet contact plate 105 located at the descended position to the retracted position.

The upward force generated by the urging force of the second spring 182 acting on the sheet contact plate 105 is greater than the downward force that causes the sheet contact plate 105 to pivot downward due to the urging force of the first spring 181. In response to the sheet contact plate 105 becoming free from the downward force, the sheet contact plate 105 is pressed upward by the push-back member 193 to return to the retracted position (refer to FIG. 12B). When the sheet contact plate 105 is located at the retracted position, the third axis C3 is located vertically above the straight line L1. The sheet contact plate 105 may be thus held at the retracted position by the downward force that causes the sheet contact plate 105 to pivot downward due to the urging force of the first spring 181. When the sheet contact plate 105 is located at the retracted position, a further upward movement of the push-back member 193 is restricted. Thus, the sheet contact plate 105 is free from the upward force of the push-back member 193.

As described above, the sheet contact plate 105 is movable further downward to the descended position from the retracted position. The descended position is opposite to the protruding position relative to the retracted position. The push-back member 193 is configured to, after the arm 106 contacts the contact portion 173 of the slider 107, urge the sheet contact plate 105 from the descended position to the retracted position.

With this configuration, after each slide shaft 162*a* of the arm 106 slides to the other end 172*b* in a corresponding elongated hole 172, the sheet contact plate 105 may be moved back to the retracted position from the descended position and held at the retracted position that may be a proper position.

The slider 107 includes the contact portion 173. The contact portion 173 of the slider 107 is configured to, while the sheet contact plate 105 moves between the protruding position and the retracted position, contact the arm 106 to move each slide shaft 162*a* from the one end 172*a* to the other end 172*b* in a corresponding elongated hole 172. With this configuration, the position of each slide shaft 162*a* may be easily changed from the one end 172*a* to the other end 172*b* in a corresponding elongated hole 172, thereby holding the sheet contact plate 105 at the retracted position easily.

The contactable portion 163 of the arm 106 contactable with the contact portion 173 of the slider 107 is located closer to the third end portion 161 than to the fourth end portion 162. In response to the contactable portion 163 of the arm 106 being pressed upward by the contact portion 173 of the slider 107, the fourth end portion 162 of the arm 106 moves upward relative to the third end portion 161 by the pivot of the arm 106 about the second axis C2.

Providing the contactable portion 163 closer to the third end portion 161 than to the fourth end portion 162 may enable the slide shafts 162*a* to move by a relatively large amount in the respective elongated holes 172 when the contact portion 173 contacts the arm 106.

Such a configuration may thus increase reliability of the movement of each slide shaft 162*a* between the one end 172*a* and the other end 172*b* in a corresponding elongated hole 172.

A description will be provided on operation of the sheet contact plate 105 and the support structure for the sheet contact plate 105 when the sheet contact plate 105 moves from the retracted position to the protruding position.

As the sheet contact plate 105 is pivoted upward about the first axis C1 by application of an upward force to the sheet contact plate 105 located at the retracted position illustrated in FIG. 12B, the third end portion 161 of the arm 106 moves upward.

In response to the third end portion 161 of the arm 106 becoming higher than the fourth end portion 162 (refer to FIG. 14), the fourth end portion 162 that is urged toward the front by the urging force of the first spring 108 moves downward and each slide shaft 162*a* moves from the other end 172*b* to the one end 172*a* in a corresponding elongated hole 172.

Figure 14:
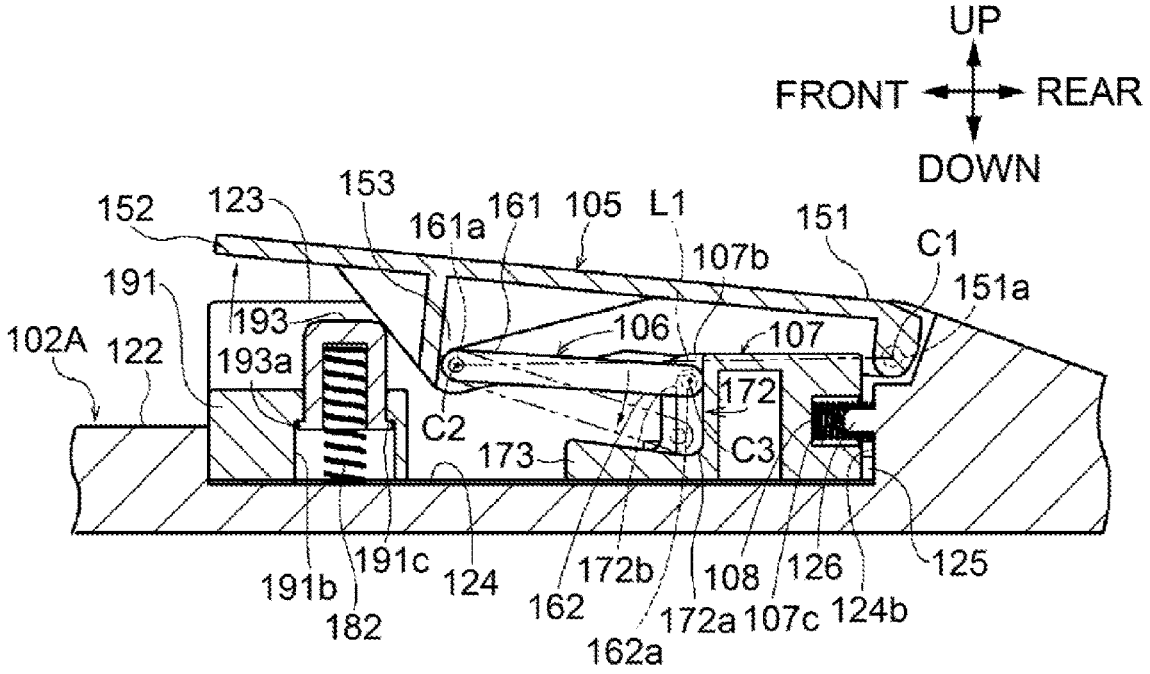
FIG. 14 is a sectional side view illustrating the sheet contact plate and the support structure for the sheet contact plate taken along line C-C of FIG. 9 according to the second illustrative embodiment of the disclosure, and explaining operation of the sheet contact plate and the support structure for the sheet contact plate while the sheet contact plate moves from the retracted position toward the protruding position.

In the state illustrated in FIG. 14, the third axis C3 of the slide shafts 162*a* is located vertically below the straight line L1.

In this state, the sheet contact plate 105 is subjected to the force that causes the sheet contact plate 105 to pivot upward due to the urging force of the first spring 108, and thus is pivoted upward to the protruding position (refer to FIG. 12A) by the upward force.

As described above, moving the sheet contact plate 105 from the retracted position to the protruding position may only require pivoting the sheet contact plate 105 upward until the third end portion 161 becomes higher than the fourth end portion 162. Changing the sheet contact plate 105 from the retracted position to the protruding position may be thus a simple operation.

While the disclosure has been described in detail with reference to the specific embodiments thereof, these are merely examples, and various changes, arrangements and modifications may be applied therein without departing from the spirit and scope of the disclosure.

What is claimed is:

1. An image forming apparatus comprising:

a discharge tray configured to receive and hold a discharged sheet having an image formed thereon;

a sheet contact plate supported by the discharge tray, the sheet contact plate including a first end portion and a second end portion that is located downstream from the first end portion in a sheet discharge direction, the sheet contact plate being pivotable on a first axis located at the first end portion between a retracted position and a protruding position, the sheet contact plate located at the protruding position being contactable with the discharged sheet;

an arm including a third end portion and a fourth end portion in a direction in which the arm extends, the third end portion being supported by the second end portion of the sheet contact plate such that the arm is pivotable on a second axis located at the third end portion;

a slider disposed at the discharge tray, the slider being slidable along the sheet discharge direction, the slider supporting the fourth end portion of the arm such that the arm is pivotable on a third axis located at the fourth end portion; and a spring urging the slider away from the first axis along the sheet discharge direction.

2. The image forming apparatus according to claim 1, wherein one of the slider and the discharge tray has a guide groove, and wherein the other of the slider and the discharge tray includes a guide rail, the guide rail being engaged with the guide groove and slidable relative to the guide groove, the groove and the guide rail being configured to guide the slider along the sheet discharge direction.

3. The image forming apparatus according to claim 1, wherein, when the sheet contact plate is located at the retracted position, the third axis is located vertically above a straight line connecting between the first axis and the second axis.

4. The image forming apparatus according to claim 3, wherein one of the slider and the arm has an elongated hole having one end and the other end opposite to the one end in an elongated direction in which the elongated hole is elongated, wherein the one end is located lower than the other end in the elongated direction, wherein the other of the slider and the arm includes a shaft engaged with the elongated hole, wherein the shaft is slidable between the one end and the other end in the elongated hole, and wherein the third axis is a rotation center of the shaft.

5. The image forming apparatus according to claim 4, wherein the slider includes a contact portion, wherein the contact portion is configured to, while the sheet contact plate moves from the protruding position to the retracted position, contact the arm to move the shaft from the one end to the other end in the elongated hole.

6. The image forming apparatus according to claim 5, wherein the arm includes a contactable portion contactable with the contact portion of the slider, wherein the contactable portion is located closer to the third end portion than to the fourth end portion.

7. The image forming apparatus according to claim 5, further comprising an urging member, wherein the sheet contact plate is movable to a descended position from the retracted position, wherein the descended position is opposite to the protruding position relative to the retracted position, and wherein the urging member is configured to, after the arm contacts the contact portion, urge the sheet contact plate from the descended position to the retracted position.

8. The image forming apparatus according to claim 7, wherein the discharge tray further includes a recessed portion, the recessed portion having an upstream wall in the sheet discharge direction, wherein the slider is disposed in the recessed portion, wherein the spring is disposed between the slider and the upstream wall.

9. The image forming apparatus according to claim 1, wherein, when the sheet contact plate is located at the protruding position, the third axis is located vertically below a straight line connecting between the first axis and the second axis.

10. The image forming apparatus according to claim 1, wherein the discharge tray further includes a rib on one side of the sheet contact plate in a first axis direction in which the first axis extends, wherein the rib extends in the sheet discharge direction and protrudes such that an upper end of the rib is located higher than the sheet contact plate located at the retracted position.

11. The image forming apparatus according to claim 10, wherein, after the second end portion of the sheet contact plate reaches below the upper end of the rib, the third axis moves from vertically below to vertically above a straight line connecting between the first axis and the second axis.

12. The image forming apparatus according to claim 1, wherein the sheet contact plate further includes a stiffening rib extending toward the discharge tray from one end of the sheet contact plate in a first axis direction in which the first axis extends, and wherein the arm is located closer to a central portion of the sheet discharge tray than the stiffening rib in the first axis direction.

13. The image forming apparatus according to claim 1, wherein the discharge tray has a recessed portion, the recessed portion having a groove guide, and wherein the slider is disposed in the recessed portion and includes a guide rail engaged with the groove guide.

14. The image forming apparatus according to claim 13, wherein the recessed portion has an upstream wall in the sheet discharge direction, and wherein the spring is disposed between the slider and the upstream wall.

15. An image forming apparatus comprising:

a discharge tray;

a sheet contact plate supported by the discharge tray, the sheet contact plate including a first end portion and a second end portion that is located downstream from the first end portion in a sheet discharge direction, the sheet contact plate being pivotable about a first axis located at the first end portion between a retracted position and a protruding position;

a slider slidable along the sheet discharge direction;

an arm including a third end portion and a fourth end portion opposite to the third end portion in a direction in which the arm extends, the third end portion being supported by the second end portion of the sheet contact plate such that the arm is pivotable about a second axis located at the third end portion, the fourth end portion being supported by the slider such that the arm is pivotable about a third axis located at the fourth end portion; and a spring urging the slider away from the first axis along the sheet discharge direction.

16. The image forming apparatus according to claim 15, wherein the discharge tray has a recessed portion, the recessed portion having a groove guide, and wherein the slider is disposed in the recessed portion and includes a guide rail engaged with the groove guide.

17. The image forming apparatus according to claim 16, wherein the recessed portion has an upstream wall in the sheet discharge direction, and wherein the spring is disposed between the slider and the upstream wall.

18. An image forming apparatus comprising:

a discharge tray;

a sheet contact plate supported by the discharge tray, the sheet contact plate including a first end portion and a second end portion that is located downstream from the first end portion in a sheet discharge direction, the sheet contact plate being pivotable about a first axis located at the first end portion between a retracted position and a protruding position;

a slider slidable along the sheet discharge direction;

an arm including a third end portion and a fourth end portion opposite to the third end portion in a direction in which the arm extends, the third end portion being supported by the second end portion of the sheet contact plate such that the arm is pivotable about a second axis located at the third end portion, the fourth end portion being supported by the slider such that the arm is pivotable about a third axis located at the fourth end portion; and a spring urging the slider away from the first axis along the sheet discharge direction, wherein, as the sheet contact plate pivots about the first axis from the retracted position to the protruding position, the slider slides away from the first axis along the sheet discharge direction, and the third end portion moves upward and the fourth end portion of the arm moves downward.

19. The image forming apparatus according to claim 18, wherein, as the sheet contact plate pivots about the first axis from the protruding position to the retracted position, the third end portion of the arm moves downward and the fourth end portion of the arm presses the slider toward the first axis against an urging force of the spring.

20. The image forming apparatus according to claim 18, wherein, when the sheet contact plate is located at the retracted position, the fourth end portion of the arm presses the slider against the urging force of the spring.

* * * * *